US012403354B2

(12) United States Patent
Mosqueda

(10) Patent No.: US 12,403,354 B2
(45) Date of Patent: Sep. 2, 2025

(54) EXERCISE DEVICE FOR STRENGTHENING GLUTEAL MUSCLES

(71) Applicant: Aaron Mosqueda, Los Angeles, CA (US)

(72) Inventor: Aaron Mosqueda, Los Angeles, CA (US)

( * ) Notice: Subject to any disclaimer, the term of this patent is extended or adjusted under 35 U.S.C. 154(b) by 118 days.

(21) Appl. No.: 18/505,992

(22) Filed: Nov. 9, 2023

(65) Prior Publication Data

US 2024/0066353 A1 Feb. 29, 2024

Related U.S. Application Data

(63) Continuation-in-part of application No. 17/647,951, filed on Jan. 13, 2022, now Pat. No. 11,833,387, (Continued)

(51) Int. Cl.
*A63B 22/02* (2006.01)
*A63B 21/00* (2006.01)
(Continued)

(52) U.S. Cl.
CPC ..... *A63B 22/02* (2013.01); *A63B 21/0615* (2013.01); *A63B 21/065* (2013.01);
(Continued)

(58) Field of Classification Search
CPC ..... A63B 21/00181; A63B 21/06; A63B 21/0615; A63B 21/0616; A63B 21/0617; A63B 21/062; A63B 21/0622; A63B 21/065; A63B 21/072; A63B 21/08; A63B 21/4023; A63B 21/4025; A63B 23/02; A63B 23/0205; A63B 23/0216; A63B 23/0233; A63B 23/04; A63B 23/0405; A63B 23/0411
See application file for complete search history.

(56) References Cited

U.S. PATENT DOCUMENTS 5,000,440 A 3/1991 Lynch
5,104,119 A 4/1992 Lynch
(Continued)

FOREIGN PATENT DOCUMENTS

WO 2009014330 A1 1/2009

OTHER PUBLICATIONS

Eli Hargis, Lying reverse hamstring curl on treadmill [online], published Aug. 15, 2017, <URL: https://www.youtube.com/watch?v: 8TQwKs4D8ZE> (Eli) (Year: 2017).
(Continued)

*Primary Examiner* — Zachary T Moore
(74) *Attorney, Agent, or Firm* — DANE IP Law PC

(57) ABSTRACT

An exercise device for strengthening muscles is disclosed, having a continuous belt system that allows a user to move the continuous belt using their feet to exercise muscles of the person while the person lies in front of the continuous belt with their back braced on a resting surface. Such an exercise device allows a user to exercise their gluteus and hamstring muscles while strengthening their pelvic stabilizers. The exercise device could also have a weight device that allows a user to rest a weight on their torso during the exercise to increase the difficulty and effectiveness of the exercise.

20 Claims, 13 Drawing Sheets

Related U.S. Application Data which is a continuation of application No. 17/225,046, filed on Apr. 7, 2021, now Pat. No. 11,253,743.

(51) Int. Cl.

| | |
|---|---|
| ***A63B 21/06*** | (2006.01) |
| ***A63B 21/065*** | (2006.01) |
| ***A63B 21/072*** | (2006.01) |
| ***A63B 21/078*** | (2006.01) |

(52) U.S. Cl.

CPC ..... *A63B 21/0724* (2013.01); *A63B 21/0783* (2015.10); *A63B 21/4039* (2015.10); *A63B 2208/0252* (2013.01)

(56) References Cited

U.S. PATENT DOCUMENTS

| | | | | |
|---|---|---|---|---|
| 5,316,535 | A | 5/1994 | Bradbury | |
| 5,830,113 | A | 11/1998 | Coody | |
| 6,152,854 | A * | 11/2000 | Carmein | A63G 31/16 198/779 |
| 7,137,937 | B2 * | 11/2006 | Croft | A63B 21/4011 482/121 |
| 7,192,388 | B2 | 3/2007 | Dalebout | |
| 7,476,183 | B1 | 1/2009 | Chrest | |
| D661,357 | S | 6/2012 | Du | |
| 8,608,624 | B2 | 12/2013 | Shabodyash | |
| 9,370,680 | B1 * | 6/2016 | Macaulay | A63B 71/023 |
| 9,409,050 | B2 * | 8/2016 | Mintz | A63B 23/03591 |
| 9,480,871 | B2 | 11/2016 | Domesick | |
| 9,782,622 | B2 | 10/2017 | Hornback | |
| 9,907,994 | B1 | 3/2018 | Maresh | |
| 10,118,064 | B1 * | 11/2018 | Cox | A63B 1/00 |
| 10,192,454 | B2 * | 1/2019 | Cakmak | A63B 24/00 |
| 10,493,309 | B2 * | 12/2019 | Jue | A63B 21/00069 |
| 10,661,114 | B2 * | 5/2020 | Watterson | A63B 21/4047 |
| 11,007,401 | B2 | 5/2021 | Kennedy | |
| 2007/0123396 | A1 | 5/2007 | Ellis | |
| 2008/0070757 | A1 * | 3/2008 | Albert | A63B 71/0009 482/54 |
| 2016/0023039 | A1 | 1/2016 | Cei | |
| 2018/0272178 | A1 | 9/2018 | Kennedy | |
| 2021/0093913 | A1 | 4/2021 | Hsu | |

OTHER PUBLICATIONS

Joel Seedman, Weighted Glute Bridge Walkout on Slide Board [online], Oct. 23, 2016, Retrieved from the Internet <URL: https://www.youtube.com/watch?v=W70Nc5-oaYQ> (Year: 2016).

Lift Vero, Extreme Lower Body Treadmill Workout [online], Apr. 10, 2010, Retrieved from the Internet <URL: https://www.youtube.com /watch?v=SENiCCntccw> (Year: 2010).

* cited by examiner

EXERCISE DEVICE FOR STRENGTHENING GLUTEAL MUSCLES

CROSS-REFERENCE TO RELATED APPLICATIONS

The present application is a continuation in part application of U.S. Ser. No. 17/647,951, filed on 2022 Jan. 13, which is a continuation application of U.S. patent application Ser. No. 17/225,046, filed on 2021 Apr. 7, the entire contents of which is expressly incorporated herein by reference.

FEDERALLY SPONSORED RESEARCH OR DEVELOPMENT

Not Applicable

BACKGROUND

Exercise devices, such as bench press racks, treadmills, and leg curl machines, are commonly purchased and used by consumers in order to strengthen their muscles at home or in a gym. There are few machines that could be used, however, to exercise gluteal muscles.

It would therefore be desirable to provide improved exercise devices and methods of using exercise machines to strengthen a person's gluteal muscles during a workout.

SUMMARY OF THE INVENTION

A system and method for exercising gluteus and hamstring muscles of a person are disclosed. The method involves disposing an exercise machine base having a conveyor belt or a continuous belt under the feet of a person while the person lies back-down on a resting surface. In some embodiments, the continuous belt could be pulled taught between at least two rollers. The continuous belt preferably is configured to move about the at least two rollers such that the continuous belt rolls around the at least two rollers. The person braces their upper back against a friction surface to hold the upper back of the person in place relative to the exercise machine while the person moves the continuous belt using their feet. By moving the continuous belt with the person's feet, the person can effectively exercise their buttock muscles while targeting their pelvic stabilizers. For example the person may use the balls of their feet to push the continuous belt away from themselves or pull the continuous belt towards themselves.

A person could increase the difficulty of the exercise by raising their torso while maintaining a minimum distance between a resting surface and the buttock muscles of the person while performing the exercise. Such a resting surface could be, for example, a resting surface that supports the base of the exercise machine, a back brace that is coupled to the exercise machine base, or a yoga mat or carpet that sits between the ground and the base of the exercise machine. The resting surface typically acts as the friction surface that the person uses to brace their upper back in place while the person moves the belt of the exercise machine.

The difficulty of the exercise can be further increased by resting a weight on the person's torso while performing the exercise. Such a weight could be positioned in any suitable location, such as the pelvis area, chest area, or the ab area of the person performing the exercise. In some embodiments the weight could be coupled to a weight bar. The weight bar could have one or more weight posts that hold the weight in place during use, such as at the center of the weight bar or on the sides of the weight bar, oriented in any suitable direction. The weight bar could be attached to the exercise machine, such as the base of the exercise machine, and could be pivotably attached to the exercise machine to allow the weight bar to move with the person as the person raises and lowers their torso.

Any machine having a continuous belt that can be moved with a person's feet could be used to perform this exercise. In some embodiments, an exercise machine could be provided that has a base and a weight bar. The base could have a continuous belt pulled taught between at least two rollers, configured to move along the rollers when a person's feet applies a force on the surface of the continuous belt. The rollers could have one or more mechanisms that increase or decrease a resistance of the continuous belt as it moves about the rollers. Such a mechanism could comprise a brake mechanism that alters a friction force applied to a roller, or a torque multiplier that changes a torque force applied to an axle with differing settings. The base could have a relatively thin thickness, which allows a person lying on a resting surface to easily place their feet on the top surface of the continuous belt. In such embodiments, the top surface of the belt could be positioned less than 3, 2, 1, or ½ feet from the top of a resting surface. The top surface of the continuous belt could be made of any suitable material having a coefficient of friction greater than 1 with a person's feet, socks, or shoes, such as rubber, plastic, or textured cloth.

The weight bar could be coupled to the base comprising the continuous belt, and could have at least one weight attachment device that holds one or more weights in place relative to the weight bar. The weight attachment device is preferably configured to evenly distribute weight on the user's torso. For example, the weight attachment device could comprise a weight post disposed at a center of the weight bar or could comprise a plurality of weight posts disposed opposite each other, equidistant from the center of the weight bar. The weight post could comprise a cylindrical protrusion having a diameter of at most 1, 2, or 3 inches. In some embodiments, a clip could be removably attached to the weight post to hold the weight in place while a user exercises using the machine. Such clips could be frictionally coupled to the weight post, for example by using a spring that releases from the weight post when force is applied to the spring and compresses against the weight post when force is not applied to the spring, or by using a clamp that could be tightened or loosened by turning a threaded fastener.

The weight bar is preferably disposed to rest on a torso of a user of the exercise machine while the user applies a pushing or pulling force to the continuous belt with their feet. The weight bar could comprise any material suitable for holding a weight, for example a metal, such as aluminum or steel, or a hard plastic. In some embodiments, the weight bar comprises a tubular or rectangular material that is bent or cut into shape.

The weight bar could have a pad or a cushion wrapped around a section of the weight bar that protects the user's torso from the force of the hard weight bar. In some embodiments, the weight bar could be removably coupled to the base in any suitable manner, for example the weight bar could be hingedly connected to the base with a threaded fastener to pivot while the user raises and lowers the weight bar, and the threaded fastener could be loosened to detach the weight bar from the base. In some embodiments, the weight bar could be configured to rotate between at least 90, 120, or 150 degrees at a pivot point. The weight bar could comprise a bracket rotateably attached to a frame of the belt system, where the bracket has a cross-bar that supports the weight on the user's stomach. Such a bracket could have one, two, or more extension members that are equal to one another in length, which are coupled to the base near a proximal end. The extension members are preferably configured such that the cross bar is positioned above a user's stomach or hips and/or below the user's shoulders during use of the exercise device. For example, the extension members could have a length between 2.5 feet and 3.5 feet. In some embodiments, the extension members could be configured to be extendable and/or retractable, for example by using telescoping extension members. In some embodiments, the weight bar could alternatively, or could also, be coupled to the base via a sliding mechanism that allows the coupling location of the weight bar to shift its position along an axis of the base. Preferably, the coupling location of the weight bar could shift its position along the major length of the base along the length of a major frame member.

The weight bar could have a flattened or rounded portion alongside that allows the weight bar to comfortably rest on the torso of the user. In some embodiments, the weight bar could comprise a substantially circular, rectangular, or square cross-sectional area to form a round bar or rectangular tube. The weight bar could also have one or more supports that holds the weight bar above a torso of the user when not in use. Such a support could be hingedly coupled to the weight bar in the similar manner as a bicycle kickstand to rotate between a support position that holds the weight bar above the torso of the user and a standby position that allows the weight bar to rest on the torso of the user. The support could be configured to pivot by at least 50, 80, 90, or 120 degrees.

Furthermore, an exercise device for strengthening gluteus muscles and hamstrings is disclosed. The exercise device may have a base having a belt system with a continuous belt that is taut between at least two rollers, a back support attached to the front of the base, the back support having a lying surface between an outer frame of the back support, the outer frame having a first longitudinal side and a second longitudinal side, the first longitudinal side having a first lengthwise slot and the second longitudinal side having a second lengthwise slot, a first attachment component slidably coupled to the first lengthwise slot of the first longitudinal side of the outer frame, and a second attachment component slidably coupled to the second lengthwise slot of the second longitudinal side of the outer frame. The first and second attachment components may be configured to have a resistance band attached thereto for the resistance band to apply a downward force on a torso of a user when the user is lying on the lying surface of the back support.

In some embodiments, the exercise device may have a first gripping handle slidably coupled to a third lengthwise slot of the first longitudinal side, and a second gripping handle slidably coupled to a fourth lengthwise slot of the second longitudinal side. In some embodiments, the first lengthwise slot may be located on a first inner surface of the first longitudinal side and the second lengthwise slot may be located on a second inner surface of the second longitudinal side. In some embodiments, the third lengthwise slot may be located on a first upper surface of the first longitudinal side and the fourth lengthwise slot may be located on a second upper surface of the second longitudinal side.

In some embodiments, the first and second longitudinal sides may be made from extrusion profile frames. In some embodiments, the first and second lengthwise slots may be either V-slots or T-slots.

In some embodiments, the first attachment component may have a first body having a first attachment ring on one end of the first body and a first sliding shaft on another end of the first body, the first sliding shaft inserted through an attachment block of the first attachment component. In some embodiments, the first gripping handle may have a shaft body with a gripping portion on one end of the shaft body and a sliding shaft on another end of the shaft body, the sliding shaft inserted through an handle block of the first gripping handle.

In some embodiments, the first and second attachment components each may have an attachment ring. In some embodiments, the first and second attachment components each may have a snap hook.

Additionally, an exercise device for strengthening gluteus muscles and hamstrings is disclosed. The exercise device may have a base having a belt system with a continuous belt that is taut between at least two rollers, the belt system being at an incline, a back support attached to the front of the base, the back support having a lying surface between an outer frame of the back support, the outer frame having a first longitudinal side and a second longitudinal side, the first longitudinal side having a first lengthwise slot and the second longitudinal side having a second lengthwise slot, a first attachment component slidably coupled to the first lengthwise slot of the first longitudinal side of the outer frame, and a second attachment component slidably coupled to the second lengthwise slot of the second longitudinal side of the outer frame. The first and second attachment components may be configured to have a resistance band attached thereto for the resistance band to apply a downward force on a torso of a user when the user is lying on the lying surface of the back support. The base may be elevated height-wise relative to the back support and the belt system inclines downwards towards the back support.

In some embodiments, the exercise device may have a first gripping handle slidably coupled to a third lengthwise slot of the first longitudinal side, and a second gripping handle slidably coupled to a fourth lengthwise slot of the second longitudinal side. In some embodiments, the first lengthwise slot may be located on a first inner surface of the first longitudinal side and the second lengthwise slot may be located on a second inner surface of the second longitudinal side. In some embodiments, the third lengthwise slot may be located on a first upper surface of the first longitudinal side and the fourth lengthwise slot may be located on a second upper surface of the second longitudinal side.

In some embodiments, the first and second longitudinal sides may be made from extrusion profile frames. In some embodiments, the first and second lengthwise slots may be either V-slots or T-slots.

In some embodiments, the first attachment component may have a first body having a first attachment ring on one end of the first body and a first sliding shaft on another end of the first body, the first sliding shaft inserted through an attachment block of the first attachment component. In some embodiments, the first gripping handle may have a shaft body with a gripping portion on one end of the shaft body and a sliding shaft on another end of the shaft body, the sliding shaft inserted through an handle block of the first gripping handle.

In some embodiments, the first and second attachment components each may have an attachment ring. In some embodiments, the first and second attachment components each may have a snap hook.

DETAILED DESCRIPTION

Figure 1:
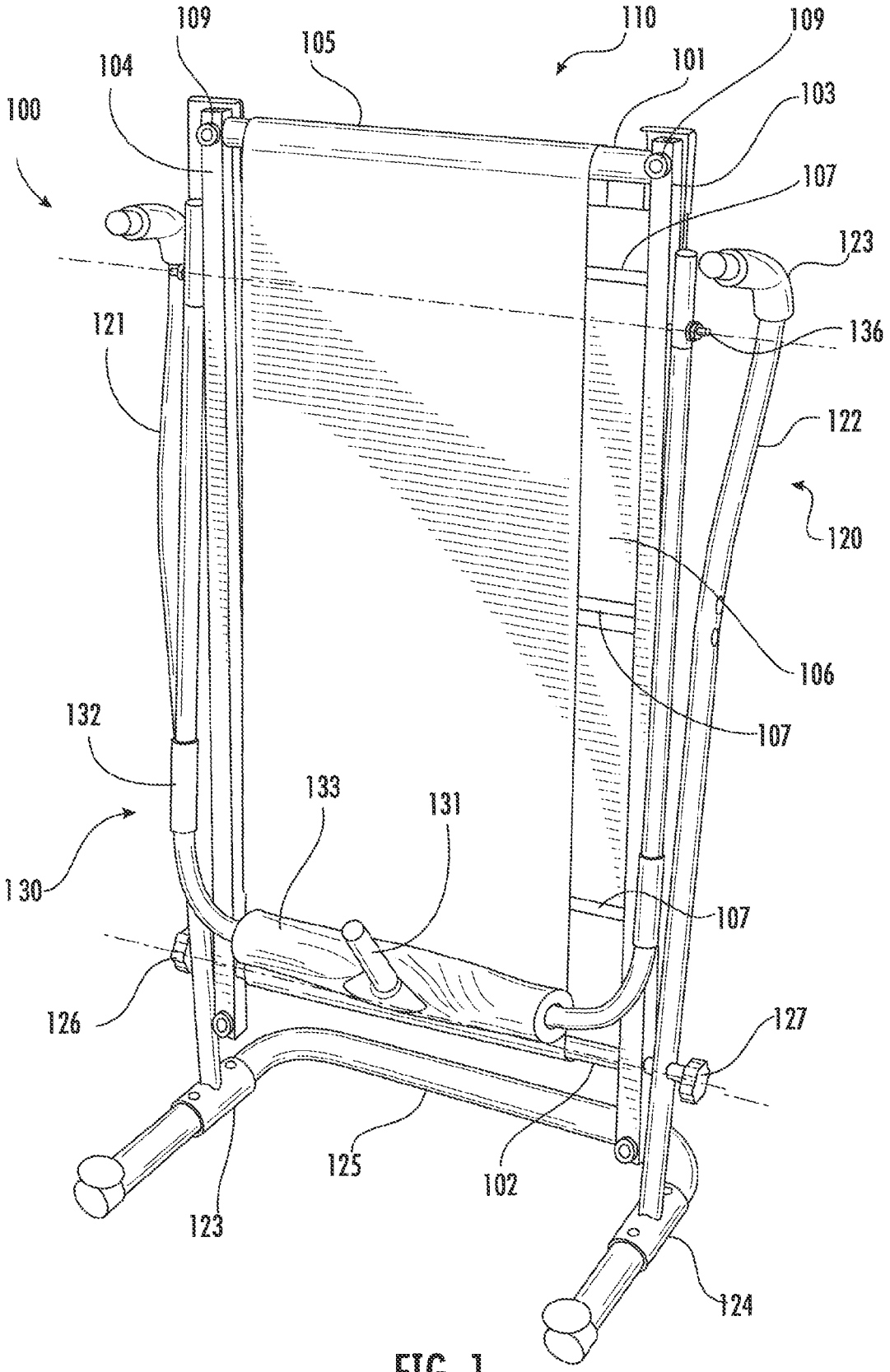
FIG. 1 shows a front perspective view of an exercise device in a storage position.

The following detailed description describes a novel exercise system and method to exercise the buttock muscles of a person.

Various exercise devices could be utilized to perform such exercises. Four different exemplary devices are shown in FIGS. 1-7 as devices 100, 100*a*, 100*b*, and 100*c*, as examples. An exemplary device typically has a continuous belt system that can be placed in front of a user's feet during the exercise. Contemplated continuous belt systems include a base having a continuous belt mounted to a frame that is pulled taught between at least two rollers. The belt could be configured to rotate about the rollers, having an upper side of the belt that is positioned less than two feet from a resting surface that the base rests upon, such as the ground. The base comprising the continuous belt could have one or more sets of wheels coupled to a side of the base that allow a user to easily wheel the base around before and after a workout session.

A weight bar could also be provided that is configured to rest on the person's torso during the workout. When the person lifts their pelvis off of the ground during the workout, the added weight from the weight bar provides added resistance during the workout. The weight bar could be configured to hold one or more weights on suitable weight attachment mechanisms, such as weight posts oriented in any suitable direction. One or more clips could be attached to such weight posts to hold the weights in place. The weight bar could be pivotally coupled to the base comprising the continuous belt. The weight bar could also have a kickstand-like support that can hold the weight bar above the person's torso to rest in between exercise sets. Also, a resistance band may be used in lieu of or in addition to the weight bar.

The exercise is conducted by a person who lies in front of a continuous belt with their back braced against a friction surface near the continuous belt and their feet positioned over the continuous belt. The person may push the continuous belt away from themselves or pull the continuous belt towards themselves using their feet to exercise and strengthen their gluteal muscles and pelvic stabilizers during a workout. The difficulty of the exercise can be increased by increasing a tension of the continuous belt to make it more difficult to move with the feet, or by raising the pelvis of the person off of the ground during the workout. A weight bar may be placed on the torso of the user, such as the chest, abs, or pelvis of the person, to further increase the difficulty of the workout. In embodiments where the weight bar is pivotally coupled to the base comprising the continuous belt, the person could conduct the exercise by placing weights on the weight bar before a workout, pivoting the weight bar off of the ground, crawling under the weight bar to rest it on the person's chest, lifting their torso, and then moving the continuous belt with their feet while maintaining holding their pelvis off of the ground.

FIG. 1 shows an exemplary exercise machine 100 in a storage configuration. The exercise machine 100 has a base 110, a pair of handles 120, and a weight bar 130. The base 110, the handles 120, and the weight bar 130 are configured to be rotatable relative to one another to allow the three elements to fold into substantially parallel positions relative to one another to allow for easy storage in a vertical arrangement. Here, the pair of handles 120 are configured to be stationary as the base 110 is rotated relative to the pair of handles 120, and the weight bar 130 is rotated relative to the base 110. As used herein, elements that are "substantially parallel" to one another have a major axis along the greatest length of the element that are parallel within 10 degrees from one another. For example, the weight bar 130 is shown as having a major axis that is about 3 degrees offset from the major axis of the base 110.

The handles 120 comprise a stabilizer 125 which is coupled to the left handle 121 via the bracket 123 and is coupled to the right handle 122 via the bracket 125. While the handles 120 are shown as separate components coupled together via brackets having threaded connector, the handles 120 could be coupled to the stabilizer 125 in any other suitable manner, or could be molded into a single unitary element having the handles and stabilizer The left handle 121 is rotatably coupled to the base 110 via a threaded fastener 126 that threads through holes (not shown) in both the left handle 121 and the base 110, while the right handle 122 is rotatable coupled to the base 110 via a threaded fastener 127 that threads through holes (not shown) in both the right handle 122 and the base 110. This allows the base 110 to rotate relative to the handles 120 via the pivot points located at the threaded fasteners 126 and 127, respectively. Each of the handles, the left handle 121 and the right handle 122 have handle cushions 123, which act to cushion any force applied to the hands of a user that grabs the cushions, similar to cushion 133. In some embodiments, the handle cushion 133 is made from a material that is stiffer than the cushions that are coupled to the left handle 121 and the right handle 122. The rotational position of the base 110 relative to the handles 120 could be locked or unlocked in place by tightening and untightening the threaded fasteners 126 and 127, respectively, as needed. While the base 110 and the handles 120 are shown as rotatably coupled to one another via threaded fasteners, other rotatable fastening mechanisms could be used, such as hinges, nuts and bolts, ball joints, axles.

In contrast, the weight bar 130 comprises a body 132 coupled to the base 110 via the fastening mechanism 136, shown here as a nut, bolt, and washer, although other rotatable fastening mechanisms could be used, as disclosed herein. It should be understood that, on the other side of the base 110 along the length of the left support 104, another fastening mechanism could be coupled to the base 110, opposite to the fastening mechanism 136, to provide two hinges upon which the weight bar 130 rotates.

Figure 2:
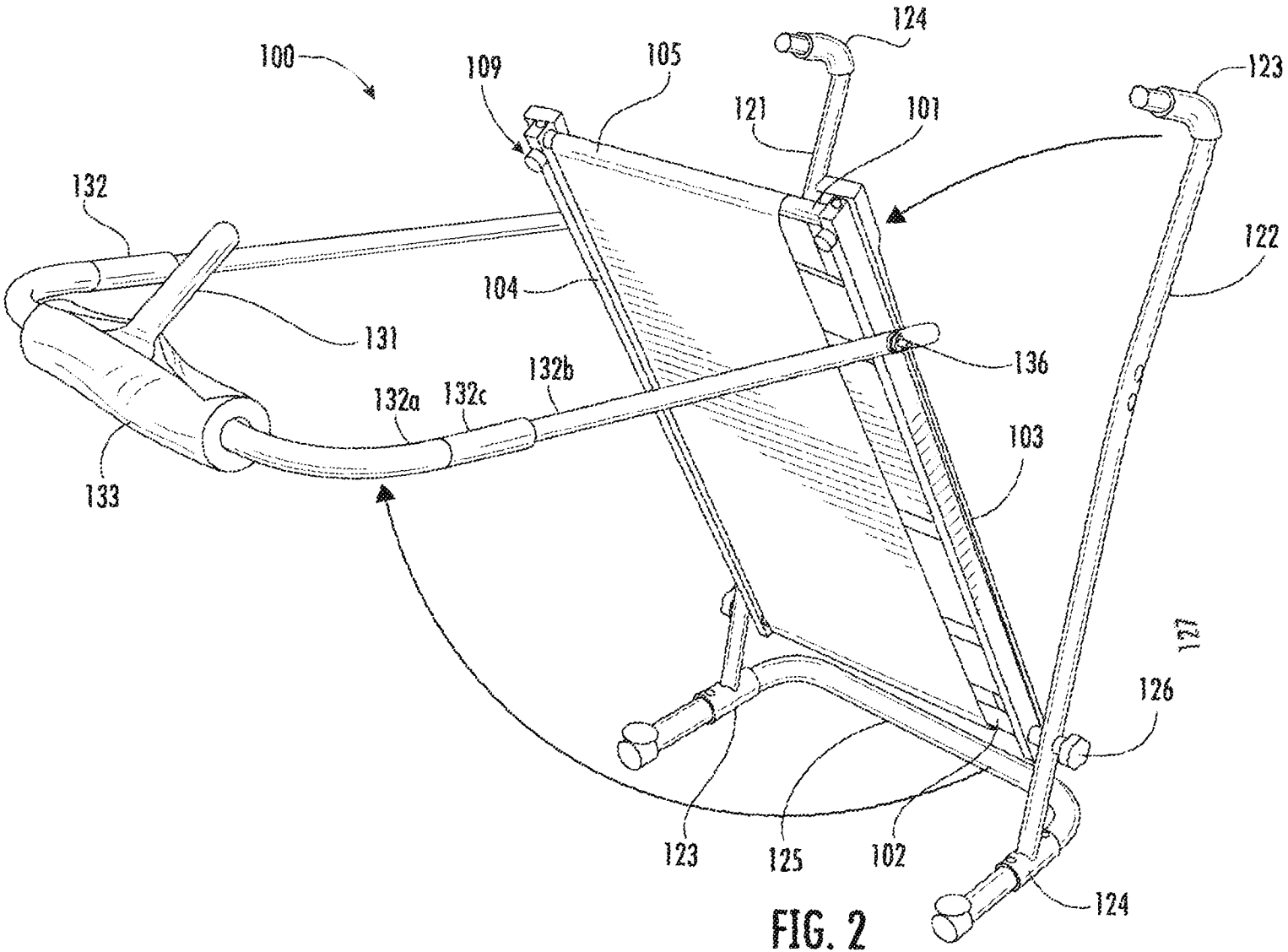
FIG. 2 shows a front perspective view of the exercise device of FIG. 1 being unfolded to an in-use position.

In some embodiments, the body 132 could have a length that is adjustable. For example, as shown in FIG. 2, the body 132 has a telescoping member 132*b* configured to slide into a cavity (not shown) of the telescoping member 132*a*. The telescoping member 132*b* is coupled to the telescoping member 132*a* using the tightening mechanism 132*c*, which locks the positions of the first and second telescoping members 132*a*, 132*b* in place relative to one another when tightened, and which allows the first and second telescoping members 132*a*, 132*b* to slide relative to one another when loosened. Such a tightening mechanism could be configured in any suitable manner to lock and unlock the sliding members in place relative to one another. Other mechanisms could be used to fix the position of telescoping members relative to one another, such as a peg with a spring that applies pressure to the peg to allow the peg to extend into a hole. A latch could be used to compress the spring until the peg is aligned with a hole that a user wishes the peg to extend into. As explained in further detail below, in other embodiments, the extension members of the body 132 could have a static length, and the position of the weight bar 130 on a user's torso 210 could be adjusted instead or in addition to by sliding the attachment mechanism 136 along a length of the base 110.

In some embodiments the fastening mechanism 136 could slide along a major axis of the length of the right support 103, such as in the embodiment shown in FIG. 7, as explained below, to allow the pivot point of the weight bar 130 to change along the length of the base 110. It should be understood that, in embodiments where the opposite side of the weight bar 130 has a fastening mechanism coupled to the left support 104, such a fastening mechanism would also slide along the length of the left support 104 along a similar rail. In such an embodiment, the weight bar 130 could be adjusted relative to the base 110 to rest on various sections of the user's torso 210. In addition, allowing the fastening point of the weight bar 130 to slide relative to the length of the base 110 could allow the weight bar 130 to slide forward towards the rollers 102 such that the weight bar 130 rests just below the rollers 105. Such a configuration allows the exercise machine 100 to be used as a standing treadmill-like leg exercise device rapidly without needing to fold the weight bar 130 underneath the base 110 or removing the fastening mechanism 136.

Since the fastening mechanism 136 comprises a washer, the entire body 132 freely rotates relative to the base 110 and does not lock the relative rotational position of the base 110 relative to the weight bar 130. This allows the weight bar 130 to freely move during the exercise without a user needing to tighten or loosen the fastening mechanism 136. By rotatably coupling the base 110, the pair of handles 120, and the weight bar 130 to one another, a user could fold the exercise machine 100 between a storage configuration shown in FIG. 1 and a ready-to-use position shown in FIG. 3 via the intermediary position shown in FIG. 2, as is explained in more detail below.

In some embodiments, the tighteners 126 and 127 could also be coupled to the roller 102, allowing the tighteners 126 and 127 to also act as a tension brake for the continuous belt 105. As the tighteners 126 and 127 are tightened, the friction force of the roller 102 could be increased, providing additional resistance for the continuous belt 105, and allowing the tighteners 126 and 127 to provide the dual functionality of providing a tension brake for the continuous belt 105 as well as a stabilizing force to prevent the base 110 from rotating relative to the handles 120 when the exercise machine 100 is in the storage configuration shown in FIG. 1.

The base 110 comprises a frame having a right support 103, a left support 104, and a continuous belt 105 that is pulled taught between two rollers 101 and 102. While two rollers are shown, more or less rollers could be used in other embodiments. The base 110 also comprises a platform 106 coupled to supports 107 between the left support 104 and the right support 103, which provides a stabilizing force under the continuous belt 105 when a user places their feet on continuous belt 105 and applies a force to the continuous belt 105 so that the continuous belt 105 rotates on the rollers 101 and 102. The base 110 also comprises feet 109 placed at the corners of the base 110 to help distance the continuous belt 105 from a resting surface, such as the ground, when the base 110 is disposed in the ready-to-use position. In some embodiments, the base 110 could be completely detached from the handles 120 to allow for a user to use the base 110 by itself as an exercise device. Such embodiments could be advantageous in areas with limited space.

The weight bar 130 comprises a body 132 rotatably coupled to the base 110 via the fasteners 136. The weight bar 130 has a weight post 131 that projects from a center of the weight bar 130, which is configured to hold one or more weights 135 when in use. A cushion member 133 is wrapped around the weight bar 130 to help distribute and soften the force from the weight bar 130. In some embodiments, the cushion member 133 comprises a softer material than the material that comprises the body 132. For example, the body 132 could comprise a thermoplastic material or a metal material, such as aluminum, and the cushion member 133 could comprise a softer material such as a foam material or a cloth padding.

Figure 4:
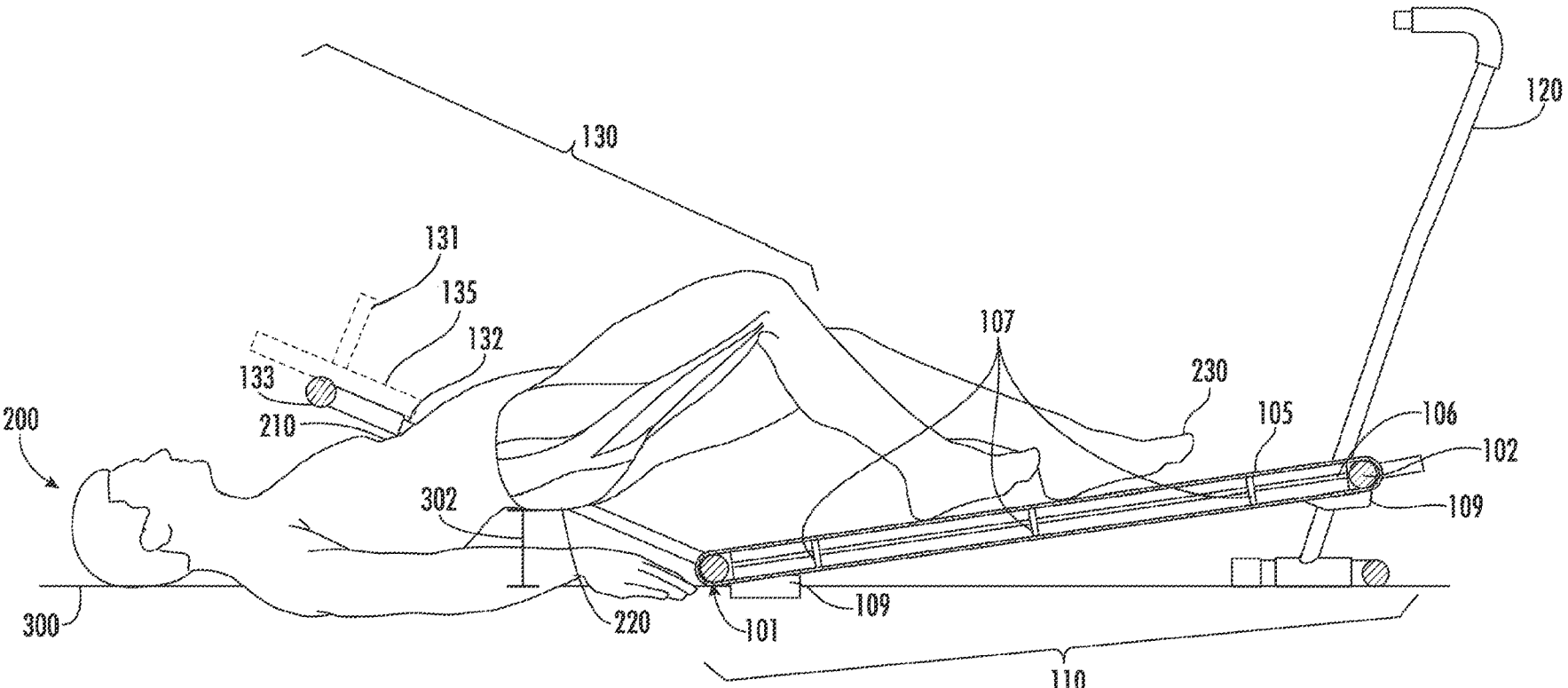
FIG. 4 shows a side plan view of the exercise device of FIG. 3.

While the weight bar 130 is shown in FIG. 4 as being a bent tube having a substantially circular cross-sectional area that rests on the torso 210 of the user 200, the weight bar 130 could comprise any suitable cross-sectional area, for example an ovoid, rectangular or a square cross-sectional area. Such a weight bar that has a lower surface that rests on the torso 210 of the user 200 which is flatter would rest easier on the torso 210 of the user 200 during use.

Figure 3:
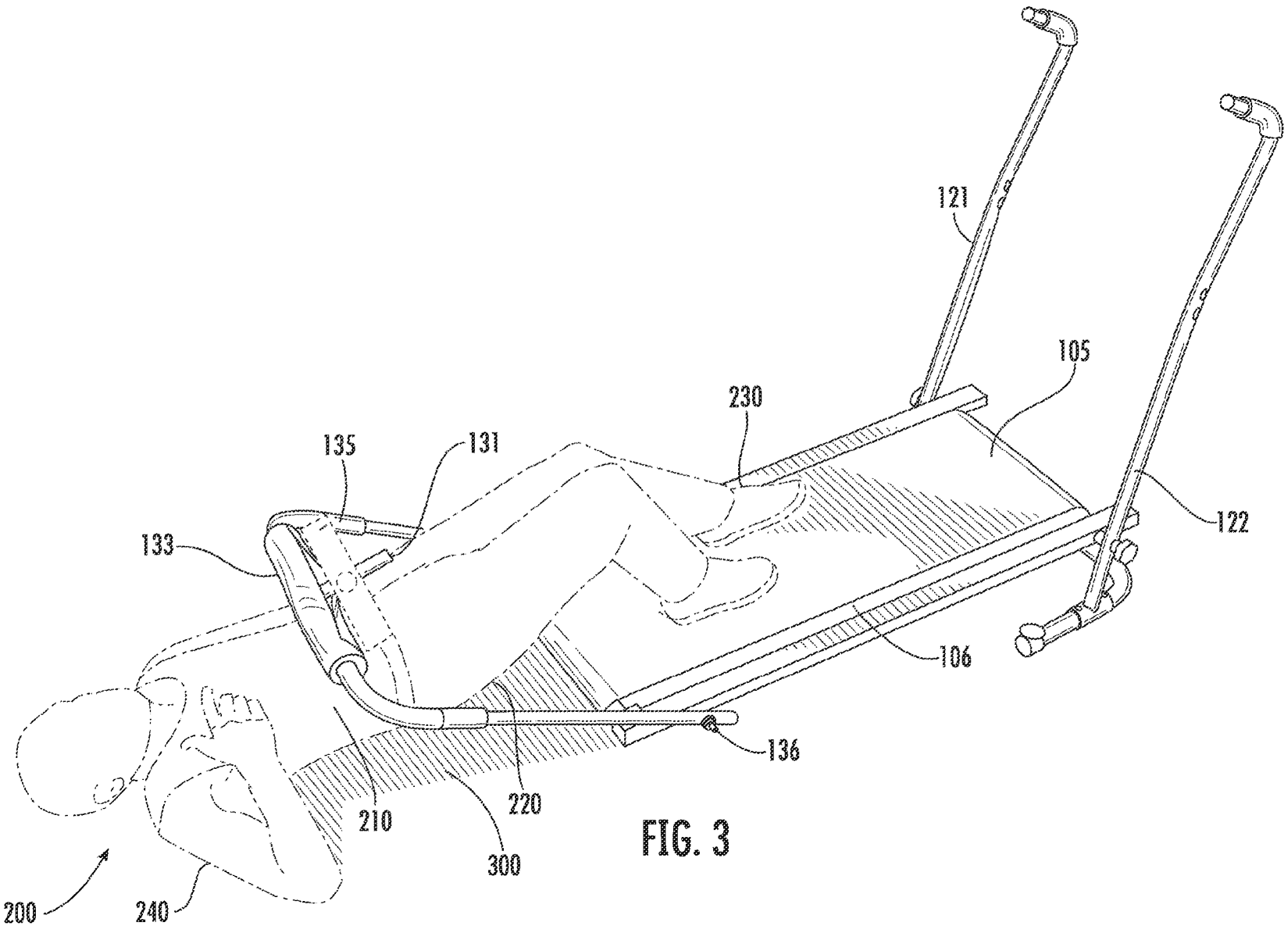
FIG. 3 shows a front perspective view the exercise device of FIG. 1 unfolded to an in-use position, with a human user using the machine to work out.

As shown in FIGS. 3 and 4, in the ready-to-use position, a user 200 could place one or more weights on the weight bar 130, lift the weight bar 130, and dispose a portion of their body under the weight bar 130 to position the cushion material 133 on a portion of the torso 210 of the user 200. Such a position allows the user 200 to exercise their back and gluteal muscles by raising the weight bar 130 a distance 302, such as 1 in., 6 in., or 12 in. The user 200 could also place one or both of their feet 230 on the surface of the continuous belt 105, allowing the user 200 to exercise their gluteal muscles by moving the continuous belt 105 with the ball of their feet 230 in either direction.

In one embodiment, a user 200 uses the exercise device 100 by lying down in front of the exercise device 100 with their feet on the continuous belt 105. The user 200 braces their back 240 against a surface, such as resting surface 300, such that the user remains in place relative to the exercise device 100, even while moving their feet against the continuous belt 105. Contemplated resting surfaces include a floor of a room, a carpet, a rug, or an exercise mat. Such resting surfaces 300 preferably have a coefficient of friction greater than 1 with materials covering the back 240, such as cloth or human skin. Once the user 200 is sufficiently braced, the user 200 could then move the top surface of the continuous belt 105 in either direction using their feet 230, such as moving the top surface of the continuous belt 105 towards the roller 102 or towards the roller 101.

Figure 5:
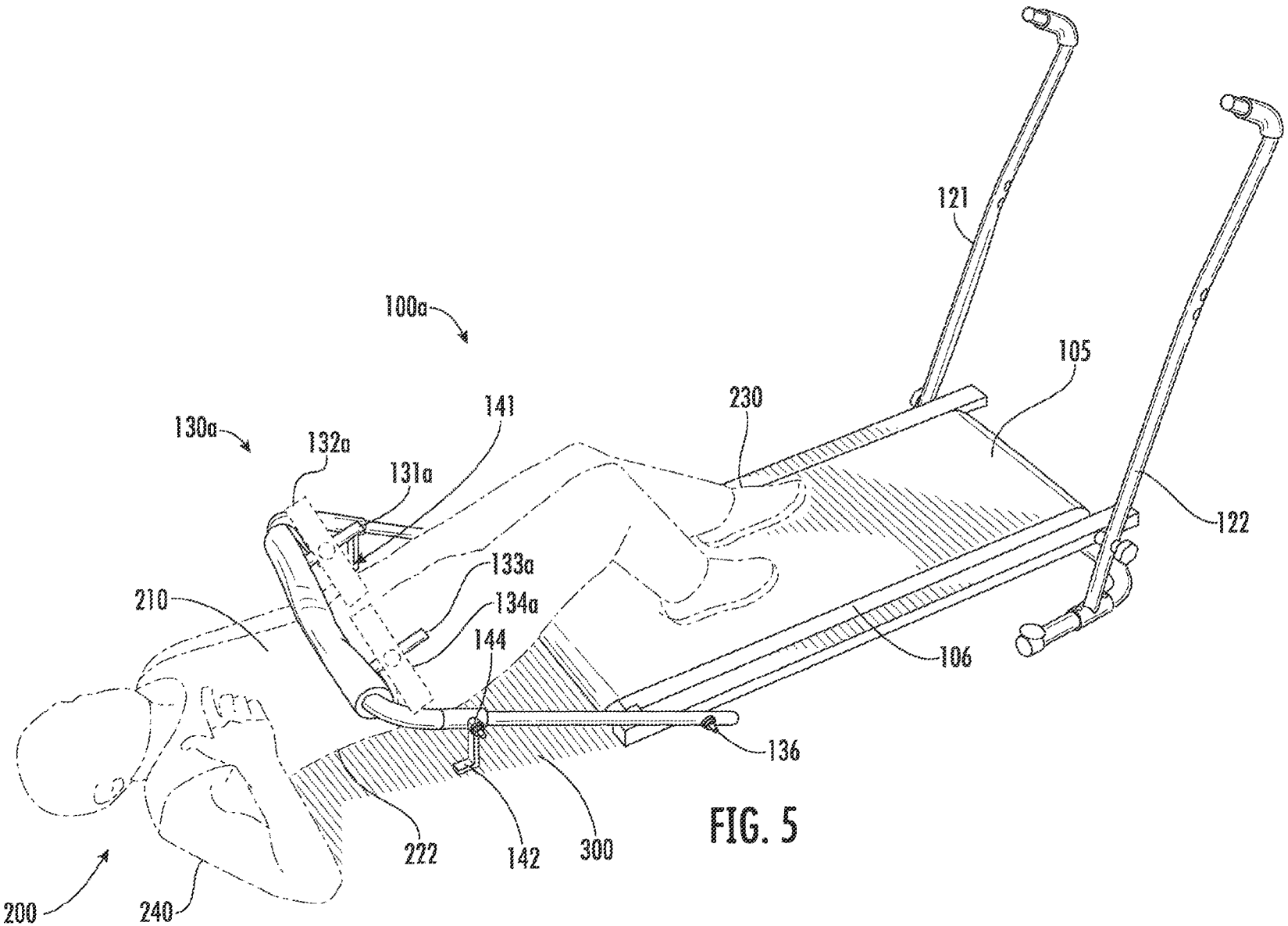
FIG. 5 shows a front perspective view of an alternative exercise device.

FIG. 5 shows an alternative exercise device 100*a* having an alternate weight bar 130*a*. The weight bar 130*a* has two weight posts 131*a* and 133*a* disposed on either side of the weight bar 130*a*. The weight 132*a* is coupled to the weight post 131*a* while the weight 134*a* is coupled to the weight post 133*a*. The weight posts 131*a* and 133*a* are preferably disposed an equal distance from the center of the body of the weight bar 130*a*, which balances the weight bar 130*a* on user 200 when the weights 132*a* and 133*a* are of equal mass.

The weight bar 130*a* also has supports 141 and 142 that are rotatably coupled to the weight bar 130*a* via the attachment mechanisms 144. The attachment mechanisms 144 are shown here as nuts, bolts, and washers, but could be any suitable rotatable attachment mechanism, as discussed herein. In some embodiments, the attachment mechanisms 144 could comprise a kickstand that is biased to maintain stability in an engaged position, as shown, or a disengaged position that is substantially parallel to the side bars of the weight bar 130*a*. The supports 141 and 142 act to hold the weight bar 130*a* above the torso 210 of the user 200 when the user 200 wants to take a rest, or wants to perform an exercise without needing to move the weight bar 130*a* to an alternative position out of the way. The supports 141 and 142 could be configured to pivot by at least 50, 80, 90, or 120 degrees from an origin angle parallel to the body 132 of the weight bar 130*a*. In some embodiments, either of the supports 141 and 142 could have a fastening system (not shown) similar to any of the fastening systems disclosed herein to fix the angle of the support in place relative to the body 132 of the weight bar 130*a*. In other embodiments, a support could be configured to freely rotate about an axis to allow the supports 141 and 142 to hang in accordance to a gravitational force.

The supports 141 and 142 could be configured to have a plurality of lengths in some embodiments. For example, the exercise device 100*a* could be configured to have a plurality of supports that could be coupled to the weight bar 130*a*, where pairs of supports are of differing lengths of other pairs of supports. For example, one pair of supports could have a length of 8 inches while another pair of supports could have a length of 12 inches. In other embodiments, the supports 141 and 142 could be comprised to have an adjustable length, for example by comprising a pair of telescoping or sliding elements relative to one another, and a locking mechanism that locks one telescoping or sliding element relative to the other, in a similar manner to the telescoping elements 132*a* and 132*b* shown in FIG. 2. By providing supports having adjustable lengths, the weight bar 130*a* could be configured to rest at different heights while in a standby position, to accommodate users having differing chest thicknesses.

Figure 6:
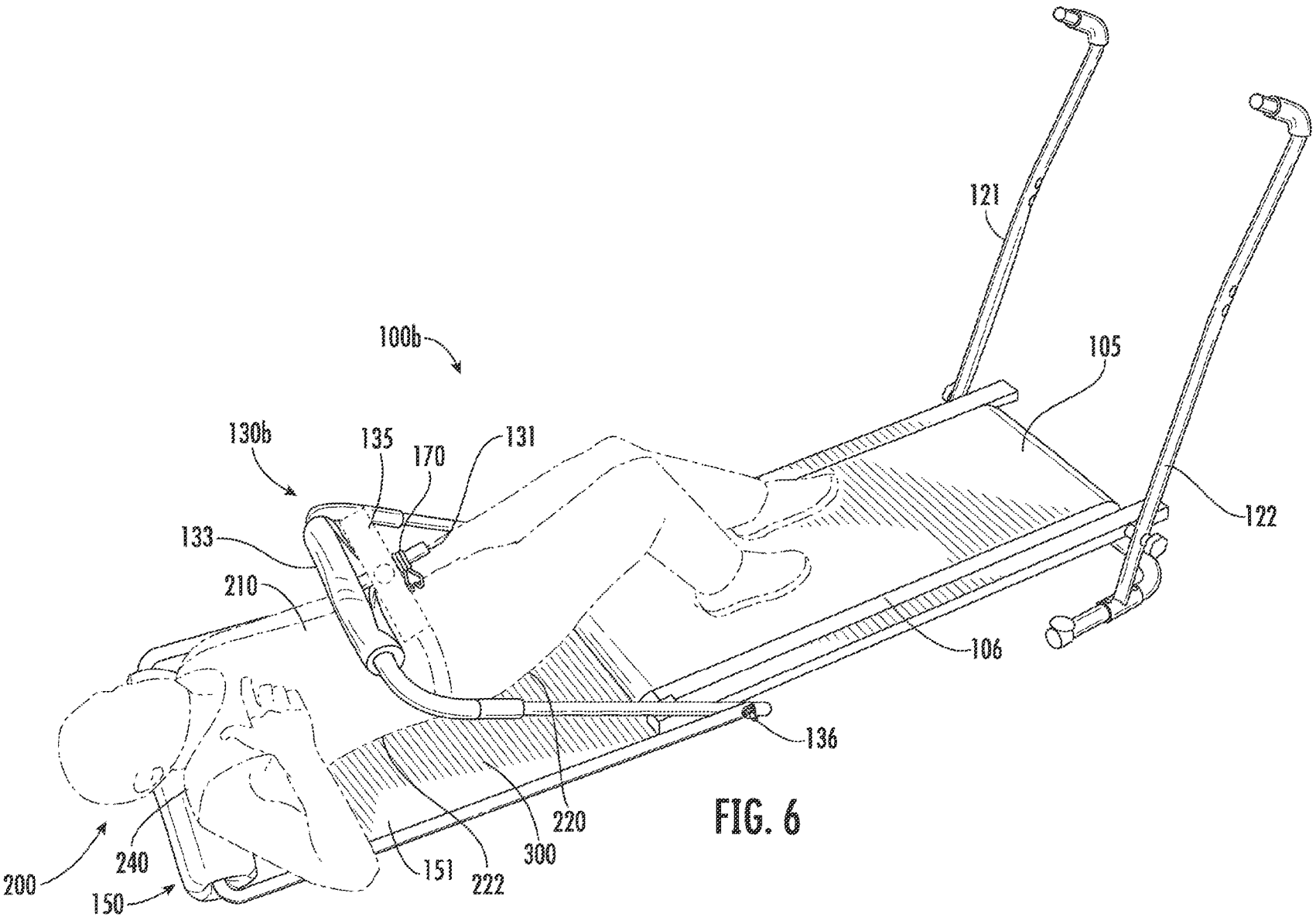
FIG. 6 shows a front perspective view of another exercise device.

FIG. 6 shows another exercise device 100*b* having a back support 150 that is used to provide a friction surface 151 that the user 200 could use to brace themselves against relative to the base 110. The back support 150 is coupled to the base 110 via attachment mechanism 136, which allows the back support 150 to rotate relative to the base 110 while still ensuring that the back 240 of the user 200 maintains a minimum threshold distance from the base 110 while exercising. While the back support 150 is shown as substantially flat to allow for users of many different heights to use the back support 150, in some embodiments back support 150 could have a curved back to match a height of a user. The top surface of back support 150 preferably comprises a surface having a high friction force when touching skin or clothing, such as rubber or plastic, which has a coefficient of friction greater than 1 with bare skin or clothing. Providing such a back support 150 with the exercise device 100*b* allows a user to use the exercise device 100*b* on any suitable surface that has a low friction force, such as a slippery wooden floor in a gym or a studio. In some embodiments, the back support 150 could be configured to have an adjustable length mechanism that allows for users of different sizes to use the same back support 150. For example, one or both of the bars along the side of the back support 150 could telescope in a similar manner to the body 132 of the weight bar 130, allowing the position of the top bulging edge of the back support 150 to move its distance from the base 110.

FIG. 6 also shows a weight clip 170 which is used to hold the weight 135 in place on the weight post 131 during use. The weight clip 170 is shown as a spring that is biased to tighten when a user 200 does not apply a clamping force to the weight clip 170, and to loosen when a user 200 applies a clamping force to the weight clip 170, but could be any suitable clip that is used to hold a weight 135 in place on a weight post 131 during use, such as a clamping clip with a threaded fastener that tightens and loosens the clip as the threaded fastener is rotated in either direction. A user 200 could remove the weight clip 170 from the weight post 131 when the user 200 wishes to remove or place weights 135 on the weight post 131, and could then couple the weight clip 170 to the weight post 131 to hold the weights 135 in place on the weight post 131.

Figure 7:
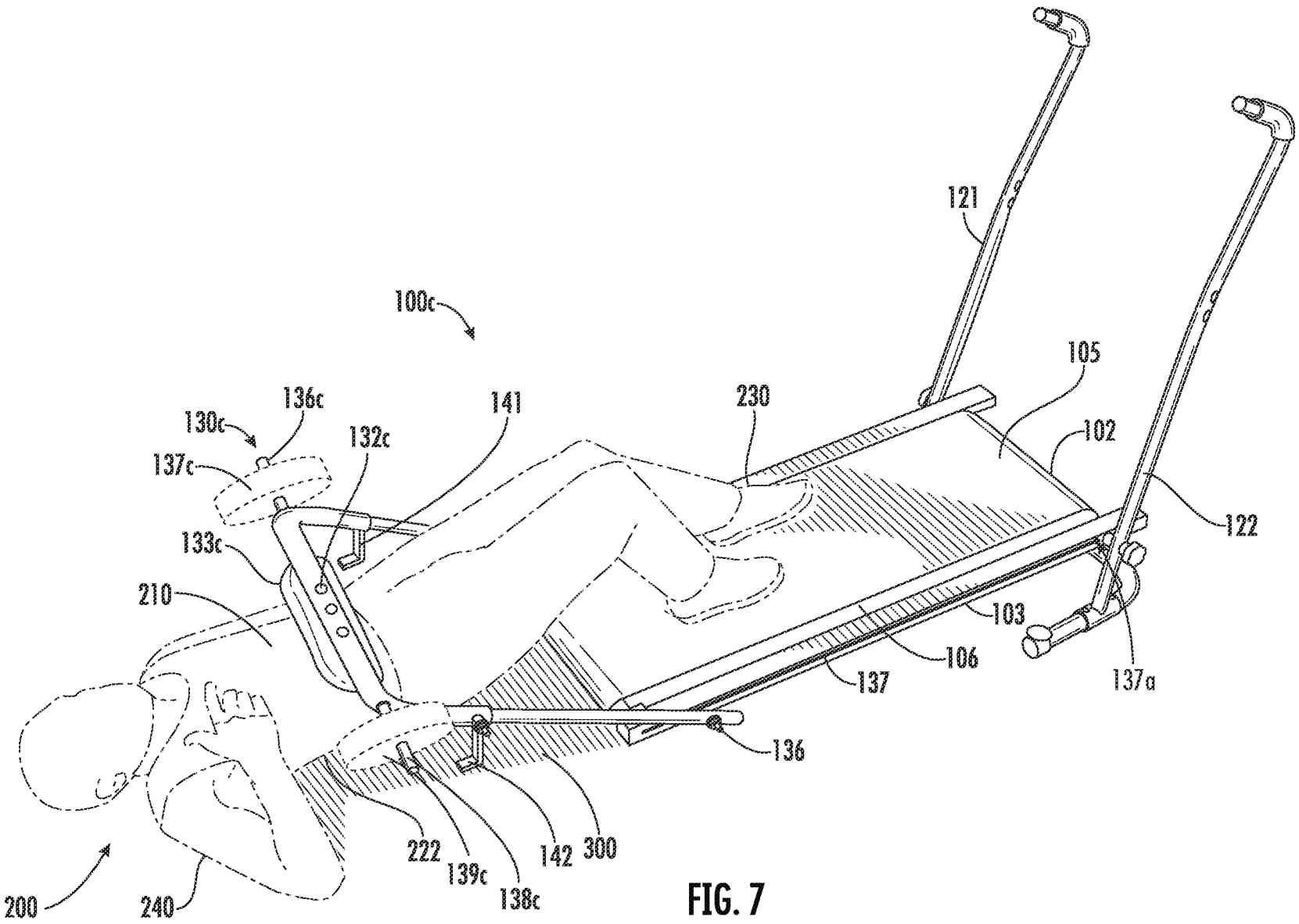
FIG. 7 shows a front perspective view of yet another exercise device.

FIG. 7 shows yet another exercise device 100*c* having an alternative weight bar 130*c* having the weight posts 136*c* and 138*c* that extend outwardly from the center of the weight bar 130*c*. The weight 137*c* is shown coupled to the weight post 136*c* while the weight 139*c* is coupled to the weight post 138*c*, although more or less weights could be coupled to the weight posts 136*c* and 138*c* in other embodiments. The weight posts 136*c* and 138*c* are preferably disposed an equal distance from the center of the body of the weight bar 130*c*, which balances the weight bar 130*c* on user 200 when the weights 137*c* and 139*c* are of equal mass. In some embodiments, the exercise device 100*c* could have one or more weight clips, such as the weight clip 170 that holds the weights 137*c* and 139*c* in place on the weight posts 136*c* and 138*c* during use. While the weight posts 136*c* and 138*c* are shown here as 4-inch projections from the sides of the body of the weight bar 130*c*, the weight posts could be any suitable length, such as projecting at most 3 inches or projecting at least 5 inches, in other embodiments.

The weight bar 130*c* also has a padding 133*c* that is fastened to the weight bar 130*c* using the fasteners 132*c*. The padding 133*c* extends from a bottom of the weight bar 130*c* to rest on the torso 210 of the user 200, allowing the compressive force from the weight bar 130*c* to distribute along the lower surface of the padding 133*c*. In some embodiments, alternative paddings (not shown) could be provided that could be interchangeable coupled to the weight bar 130*c* to provide for multiple different weight distribution configurations to be used on the torso 210 of the user 200.

The fastening mechanism 136 of the weight bar 130*c* is also coupled to a sliding rail 137. Generally, the opposing side (not shown) of the exercise device 100*c* would also have a similar sliding rail, which would allow the weight bar 130*c* to slide along the length of the right support 103.

Preferably, when a user tightens the fastening mechanism 136, the fastening mechanism 136 would fix the weight bar 130*c* in place along the length of the right support 103 to prevent the weight bar 130*c* from sliding along the length of the right support 103, while still allowing the weight bar 130*c* to pivot relative to the base 110. Such functionality could be achieved by using any suitable means, for example by disposing a compressive washer between the weight bar 130*c* and the base 110 and a non-compressive washer between the weight bar 130*c* and the wing nut. Such a configuration allows the user 200 to adjust the position of the weight bar 130*c* along the length of the user's torso 210, such that the weight bar 130*c* could be configured to comfortably rest on the user's stomach, solar plexus, or chest. Such a configuration also allows users of different heights to use the same weight bar in the same manner.

In some embodiments, the sliding rail 137 could comprise a separate locking mechanism to lock the weight bar 130*c* in place along the length of the sliding rail 137, in addition to, or separate from the fastening mechanism 136. For example, at the end of the sliding rail 137, a spring-loaded ball detent 137*a* could be provided that locks the end of the weight bar 130*c* in place when the fastening mechanism 136 of the weight bar 130*c* slides to interact with the spring-loaded ball detent 137*a*. A user 200 could loosen the fastening system 136 to slide the weight bar 130*c* along the sliding rail 137, slide the weight bar 130*c* such that the end of the weight bar 130*c* locks with the spring-loaded ball detent 137*a* while resting the handle of the weight bar 130*c* underneath the base 110 next to the feet 109, and then could use the base 110 without the weight bar 130*c*. When the user 200 wishes to use the weight bar 130*c*, the user 200 could push the spring-loaded ball detent 137*a* to unlock the weight bar 130*c* to slide it closer to the roller 101, and then could lock the weight bar 130*c* in place using the fastening mechanism 136. Any suitable locking mechanism that prevents the weight bar 130*c* from sliding along the length of the sliding rail 137 could be utilized, such as an orthogonal path downwards that the fastening mechanism 136 falls into while the weight bar 130*c* is slid forward, and must be pulled out of in order for the weight bar 130*c* to slide back to the ready in-use position shown in FIG. 7.

In another embodiment, a portion of the weight bar 130*c* could comprise a mechanism separate from the fastening mechanism 136 that mates with a portion of the base 110 to lock in place. For example, one or more of the fasteners 132*c* could comprise a head that mates with a detent (not shown) positioned below the base 110, to lock the weight bar 130*c* in place against the bottom surface of the base 110. Such detent coupling mechanisms could be formed in any suitable surface, such as one or more of the supports 107. The weight bar 130*c* could therefore slide forward along the sliding rail 137 to mate with the lower surface of the base 110 and be locked in place when not in use, or when the exercise device is folded into a storage position.

In some embodiments, where a user 200 may wish to utilize the exercise device 100*c* as a standing leg exercise device by holding the left and right handles 121 and 122, respectively, the user 200 may slide the weight bar 130*c* as far as possible towards the roller 102 such that the u-shaped handle of the weight bar 130*c* rests underneath the roller 101. In such embodiments, the feet 109 are preferably configured to position the underside of the continuous belt 105 a greater height than the thickness of the weight bar 130*c*, such as more than 3 inches, 4 inches, 5 inches, or even 6 inches. By allowing the weight bar 130*c* to slide up towards the roller 102 along the sliding rail 137, a user 200 could easily position the weight bar 130*c* out of the way by loosening fastening mechanism 136, sliding the fastening mechanism 136 towards the roller 102 while keeping the u-shaped handle of the weight bar 130*c* low and tucking it under the underside of the continuous belt 105, and then by tightening the fastening mechanism 136. After such a change in configuration, the user 200 could then stand on the continuous belt 105 and hold onto the left and right handles 121 and 122, respectively, while moving the continuous belt 105 with their feet in the manners described herein.

In some embodiments, a torque multiplier/reduction gear could be coupled to one or both of roller 101 and/or 102 to increase or decrease a resistance to rotation of the belt 105 as it rotates about the rollers 101 and 102. Such a gear could comprise any suitable shape, such as the fastener 126 and 127, which are configured to increase/decrease a resistance applied to the roller 102 to adjust a resistance applied against rotation of the belt 105 about the rollers. In some embodiments, a surface of one or both of the rollers is not smooth, to increase a friction force between an outer surface of the roller and the inner surface of the belt 105. For example, an outer surface of the roller 102 could be configured to have 1 mm deep projections or recesses every 2 mm to increase a friction force, or could comprise a high-friction material such as carpeting or rubber. In some embodiments, the friction force of the torque gear could comprise a plurality of discrete settings, each one applying a different amount of force between the surface of the roller and the belt 105. In one embodiment, rotating the torque gear 126 could tighten or loosen a screw against an axle upon which the roller 102 rotates, tightening or releasing, respectively, a brake pad applied to the axle to increase resistance of the 102 against a rotating motion. In another embodiment, the torque gear 126 could move a distance of the roller 102 from the roller 101, where rotating the torque gear in 126 in one direction moves the roller 102 away from the roller 101, tightening the belt 105 and increasing a friction force, whereas rotating the torque gear 126 in an opposite direction moves the roller 102 towards the roller 101, loosening the belt 105 and decreasing the friction force.

Exercise machines, such as the exercise machines 100, 100*a*, 100*b*, and 100*c* shown in FIGS. 1-7 could be utilized by users in various advantageous ways. By rotatably coupling the base 110, the pair of handles 120, and the weight bar 130 to one another, a user could fold the exercise machine 100 between the storage configuration shown in FIG. 1 and the ready-to-use position shown in FIG. 3 via the intermediary position shown in FIG. 2. For example, when folding the exercise machine 100 from the ready-to-use position shown in FIG. 3 to the storage configuration shown in FIG. 1, the threaded fasteners 126 and 127 could be loosened to allow the base 110 to rotate relative to the pair of handles 120. The user could then pull up the base 110 towards a vertical configuration substantially parallel to the pair of handles 120, such as the vertical configuration shown in FIG. 1. Once the base 110 is in such a vertical configuration, the user could tighten the threaded fasteners 126 and 127 to hold the rotational position of the base 110 and the pair of handles 120 in place relative to one another. While the base 110 is being lifted to the vertical configuration, the user could also maneuver the weight bar 130 to rotate towards the bottom of the base 110 to rest on the bottom surface of the base 110 as shown in FIG. 1.

When folding the exercise machine 100 from the storage configuration shown in FIG. 1 to the ready-to-use position shown in FIG. 3, a user could, again, loosen the threaded fasteners 126 and 127 to allow the base 110 to rotate relative to the pair of handles 120. The user could then lift the weight bar 130 and rotate it towards the top surface of the base 110 as shown in FIG. 2 while simultaneously pulling the base 110 down such that the edge of the base 110 with the roller 101 rests on the ground, as shown in FIG. 3. Once the exercise machine 100 is in the ready-to-use position as shown in FIG. 3, the user could choose to tighten the threaded fasteners 126 and 127 to hold the base 110 and the pair of handles 120 in place relative to one another, or could leave the threaded fasteners 126 and 127 untightened depending upon need.

For example, in embodiments where the tighteners 126 and 127 act to adjust a resistance acting against rotation of the continuous belt 105, the user could tighten either tightener 126 or tightener 127 to increase resistance when the continuous belt 105 rotates about the rollers 101 and 102. In some embodiments, the tighteners 126 and 127 could have visual indicators (not shown) that indicate how much braking force is being applied to the roller 102, such as a "1" for 1 lb. of braking force, a "2" for 2 lb. of braking force, and a "3" for 3 lb. of braking force. Once an appropriate amount of braking force has been applied to the roller 102, a user 200 could use the exercise device 100 to exercise their buttock muscles. In other embodiments, resistance applied against the rotation of the continuous belt 105 could be utilized by a second resistance device, such as a gear multiplier and/or a tension brake that is directly coupled to either of the rollers 101 and 102.

In one embodiment, a user 200 uses the exercise device 100 by lying down in front of the exercise device 100 with their feet on the continuous belt 105 as shown in FIG. 3. The user 200 braces their back 240 against a surface, such as resting surface 300, such that the user remains in place relative to the exercise device 100, even while moving their feet against the continuous belt 105. Contemplated resting surfaces include a floor of a room, a carpet, a rug, or an exercise mat. Such resting surfaces 300 preferably have a coefficient of friction greater than 1 with materials covering the back 240, such as cloth or human skin. Once the user's back 240 is properly braced against a surface, such as resting surface 300 or back support 150, the user can use the exercise device 100 by moving their feet 230 against the surface of the continuous belt 105. While FIGS. 3-7 show the user 200 performing exercises by first placing the weight pad 133 of the weight bar 130 on the user's torso, in some embodiments the user 200 may not use the weight bar 130 at all, for example by folding the weight bar 130 out of the way, by completely removing the weight bar 130 by removing the attachment mechanisms 136, or by sliding the weight bar 130 along the base 110 until a portion of the weight bar 130 is tucked under the base 110.

In one embodiment, the user 200 "walks" the continuous belt 105 forward, in a clockwise direction from the perspective shown in FIG. 4. To do so, the user 200 could place the balls of both of their feet 230 on the top surface of the continuous belt 105 with both knees bent. The user 200 could retract their left knee while directing more of their body weight on their right foot and pushing down with their right knee to push the ball of their right foot down against the top surface of the continuous belt 105, away from the body of the user 200. This causes the user 200's right foot to push the top surface of the continuous belt 105 towards the roller 102 and slide forward underneath the user 200's left foot. The user 200 then repeats this process with the opposite feet. In other words, the user 200 then retracts their right knee and directs more of their body weight on their still-retracted left foot and pushes down with their left knee to push the ball of their left foot down against the top surface of the continuous belt 105, away from the body of the user 200. This causes the user 200's left foot to push the top surface of the continuous belt 105 towards the roller 102 and slide forward underneath the user 200's right foot. By repeating this process, the user 200 "walks" the continuous belt 105 forward, in a clockwise direction as seen in FIG. 4.

In another embodiment, the user "walks" the continuous belt 105 backwards, in a counterclockwise direction from the perspective shown in FIG. 4. To do so, the user 200 could place the balls of both of their feet 230 on the top surface of the continuous belt 105 with both knees bent. The user 200 could then extend their left knee while directing more of their body weight on their right foot and retracting their right knee to pull the ball of their right foot 230 towards the buttocks 220 of the user 200 while the ball of their right foot 230 is pressed against the top surface of the continuous belt 105. This causes the user 200's right foot to pull the top surface of the continuous belt 105 towards the roller 101 while the user 200's left foot extends forwards. The user 200 then repeats this process with the opposite feet. In other words, the user 200 extends their right knee while directing more of their body weight on their extended left foot and retracts their left knee to pull the ball of their left foot 230 towards the buttocks 220 of the user 200 while the ball of their left foot 230 is pressed against the top surface of the continuous belt 105. This causes user 200's left foot to pull the top surface of the continuous belt 105 towards the roller 101 and slide backwards underneath the user 200's right foot. By repeating this process, the user 200 "walks" the continuous belt 105 backwards, in a counterclockwise direction as seen in FIG. 4.

In another embodiment, the user 200 uses one foot to "push" the continuous belt 105 forwards while bracing their other foot against the resting surface 300. To do so, the user 200 could place their left foot on the resting surface 300 just next to the roller 101. The user 200 could then place the ball of their right foot on the top surface of the continuous belt 105 and push down with their right knee to push the ball of their right foot down against the top surface of the continuous belt 105, away from the body of the user 200. This causes the user 200's right foot to push the top surface of the continuous belt 105 towards the roller 102. The user 200 could then retract their right knee to place the ball of their right foot on the top surface of the continuous belt closer to the roller 101 and repeat this process, repeatedly pushing the top surface of the continuous belt 105 towards the roller 102 with the same right foot, rotating the continuous belt clockwise as seen in the perspective of FIG. 4. The user 200 could then switch the feet after a threshold number of sets have been performed, such as 5, 10, or 20. The user 200 could then place their right foot on the resting surface 300 next to the roller 101 and place the ball of their left foot on the top surface of the continuous belt 105. The user 200 could then push down with their left knee to push the ball of their left foot down against the top surface of the continuous belt 105 away from the body of the user 200. The user 200 could then retract their left knee to place the ball of their left foot on the top surface of the continuous belt closer to the roller 101 and repeat this process, repeatedly pushing the top surface of the continuous belt 105 towards the roller 102 with the same left foot, rotating the continuous belt clockwise as seen in the perspective of FIG. 4.

In another embodiment, the user 200 uses one foot to "pull" the continuous belt 105 backwards while bracing their left foot against the resting surface 300. To do so, the user 200 could place their left foot on the resting surface 300 just next to the roller 101. The user 200 could then extend their leg and place the ball of their right foot on the top surface of the continuous belt 105 closer to the roller 102, and retract their right knee while pushing their right foot downwards against the top surface of the continuous belt 105, pulling it towards the body of the user 200. This causes the user 200's right foot to pull the top surface of the continuous belt 105 towards the roller 101. The user 200 could then extend their right knee to place the ball of their right foot on the top surface of the continuous belt closer to the roller 102 and repeat this process, repeatedly pulling the top surface of the continuous belt 105 towards the roller 101 with the same right foot, rotating the continuous belt counterclockwise as seen in the perspective of FIG. 4. The user 200 could then switch the feet after a threshold number of sets have been performed, such as 5, 10, or 20. The user 200 could then place their right foot on the resting surface 300 next to the roller 101 and extend their left leg to place the ball of their left foot against the top surface of the continuous belt 105. The user 200 could then retract their left knee while pushing the ball of their left foot down against the top surface of the continuous belt 105 to pull the top surface of the continuous belt 105 towards from the body of the user 200. The user 200 could then extend their left knee to place the ball of their left foot on the top surface of the continuous belt closer to the roller 102 and repeat this process, repeatedly pulling the top surface of the continuous belt 105 towards the roller 101 with the same left foot, rotating the continuous belt counterclockwise as seen in the perspective of FIG. 4.

The user 200 could increase the difficulty of the exercise by lifting their buttocks 220 such that they maintain a minimum threshold distance 302 between their buttocks 220 and the resting surface 300, such as at least 1 in. at least 4 in., at least 6 in., at least 10 in., or at least 12 in., during the exercise. By maintaining such a minimum threshold distance 302 while performing an exercise, the user's abdominal muscles and buttock muscles remain engaged without rest while performing the exercise.

The user 200 could further increase the difficulty of the exercise by resting the weight bar 130 on their torso 210 while maintaining the minimum threshold distance 302. While only one weight is shown on the weight post 131, additional weight or less weight could be applied to the weight bar 130 by coupling a suitable number of weights 135 to the weight post 131. As previously stated, in some embodiments, the user 200 might not want to use the weight bar 130 during an exercise, in which case the weight bar 130 could be folded back against the top or underside of the base 110, the weight bar 130 could be removed from the base 110 altogether by removing fasteners 136, or the weight bar 130 could be slid underneath the base 110 using a slider, such as the sliding rail 137.

When using the weight bar 130, the user 200 generally first couples one or more weights to the weight post 131 of the weight bar 130. Then, the user 200 could position themselves under the weight bar 130 such that the pad 133 rests on a portion of the torso 210 of the user 200, such as the user's chest, abdominals, or pelvic area. The user 200 could then brace their back 240 against the resting surface 300 and lift their buttocks 220 such that they maintain a minimum threshold distance 302 between their buttocks 220 and the resting surface 300. By lifting their buttocks 220 the minimum threshold distance 302, the user 220 also raises the weight bar 130 via the pad 133, thereby engaging their buttock and core muscles while performing the exercise. Any of the aforementioned exercises could then be performed while the user maintains the minimum threshold distance 302 between their buttocks 220 and the resting surface 300.

When a user 200 uses the exercise machine 100*a* with the weight bar 130*a* shown in FIG. 5, the user 200 could use the weight bar 130*a* in a similar manner as the weight bar 130. The user 200 could either fold the weight bar 130*a* out of the way or remove the weight bar 130*a* completely by removing the attachment mechanisms 136 if the user 200 does not wish to use the weight bar 130*a*. In embodiments with a slider, the weight bar 130*a* could be slid along the length of the base 110 to move it out of the way. The user 200 could also add or remove additional weights to the weight posts 131*a* and 133*a* to increase resistance. Once the user 200 positions themselves below the weight bar 130*a*, the user 200 could push the weight bar 130*a* upwards with their torso 210 as shown to exercise in a similar manner to exercising with the weight bar 130 of the exercise device 100. When the user 200 wishes to take a break, the user 200 could then rest their buttocks 220 on the resting surface 300, which would then cause the two weight supports 141 and 142 to drop down to the resting surface 300. Such a position allows the weight of the weight bar 130*a* to be fully supported by the two weight supports 141 and 142, and not be supported by the torso 210 of the user 200, allowing the user 200 to rest in between sets. When the user 200 wishes to, again, exercise, the user 200 could then push the weight bar 130*a* upwards with their torso 210 as shown to continue the exercise. In some embodiments, when a user 200 does not wish to use the two weight supports 141 and 142, the user 200 could rotate the weight supports 141 and 142 to be substantially parallel to the side bars of the weight bar 130*a* and tighten the attachment mechanisms 144 to prevent the weight supports 141 and 142 from rotating relative to the body of the weight bar 130*a*.

When a user 200 uses the exercise device 100*b* with the weight bar 130*b* and the back support 150 shown in FIG. 6, the user 200 could use the weight bar 130*b* in a similar manner as the weight bar 130. The user 200 could either fold the weight bar 130*b* out of the way or remove the weight bar 130*b* completely by removing the attachment mechanisms 136 if the user 200 does not wish to use the weight bar 130*b*. In embodiments with a slider, the weight bar 130*b* could be slid along the length of the base 110 to move it out of the way. Similarly, the user 200 could either fold the back support 150 out of the way or remove the back support 150 completely by removing the attachment mechanisms 136 if the user 200 does not wish to use the back support 150. When a user 200 wishes to use both the weight bar 130*b* and the back support 150, the user 200 could first pull up on the back support 150 to ensure the back support 150 rests on a resting surface while unfolding the exercise device 100*b* to the ready-to-use position. The user 200 could then couple a suitable number of weights 135 to the weight post 131 and holds the weights 135 in place using the clamp 170. The user 200 could then position the weight bar 130*b* on their torso 210 while bracing their back 240 against the back support 150. While the back support 150 is shown here as coupled to the exercise device 100*b* via the attachment mechanism 136, detached back supports could be used, such as a yoga mat, which could be coupled to the exercise device 100*b* by placing the mat underneath the feet 109 of the exercise device 100*b* to hold the detached back support in place relative to the exercise device 100*b*.

When a user 200 uses the exercise device 100*c* with the weight bar 130*c* shown in FIG. 7, the user could place the weight bar 130*c* on the resting surface 300 such that the support posts 141 and 142 hold the weight of the weight bar 130*c* when the exercise device 100*c* is in the ready-to-use position shown. The user could then couple any number of weights, such as the weights 137*c* and 139*c* to the weight posts 136*c* and 138*c*, respectively. In some embodiments, the user 200 could use clamps, such as clamp 170 in FIG. 6, to hold the weights in place on the weight posts 136*c* and 138*c*. Since the support posts 141 and 142 hold the weight bar 130*c* above the resting surface 300 in the ready-to-use position, the user 200 does not need to lift the weight bar 130*c* from the resting surface 300 to place the weights on the weight posts 136*c* and 138*c*. The user 200 could then position themselves underneath the weight bar 130*c* as shown in FIG. 7, and lift the weight bar 130*c* upwards using their torso 210 to press upwards on the padding 133*c*, thereby maintaining a minimum distance between their buttocks 220 and the resting surface 300. The user 200 could maintain that minimum distance 302 while moving the continuous belt 105 with their feet 230 in any of the manners described above. When the user 200 wishes to rest, the user 200 could rest their buttocks 220 on the resting surface 300, allowing the support posts 141 and 142 to hold the weight of the weight bar 130*c* between sets.

In some embodiments, the support posts 141 and 142 could be configured to fold out of the way to allow the user 200 to rest the weight bar 130*c* directly on the user's torso 210 while the user's back 240 is resting on a resting surface. Such a configuration allows the user 200 to perform hip thrusts while the user's back 240 is resting on the resting surface, but also allows the user 200 to allow the support posts 141 and 142 to be used to prevent the weight bar 130*c* from resting directly on the user's torso 210 in other configurations. Enabling such flexibility could be appropriate, for example, when the weight bar 130*c* is resting on a different portion of the user's torso 210 or when the weight bar 130*c* is holding a different amount of weight. The support posts 141 and 142 could be biased to rest in a disengaged position substantially parallel to the weight bar 130*c* or in an engaged position substantially non-parallel to the weight bar 130*c* (e.g. perpendicular, acute, or obtuse), similar to a bicycle kickstand.

In some embodiments, the user 200 could even use an exercise device, such as exercise device 100, while standing to exercise their leg and gluteal muscles. For example, the user 200 could stand on the top surface of the continuous belt 105 while holding onto the handles 120. While the user grips the left handle 121 with their left hand and the right handle 122 with their right hand, respectively, the user 200 could then use their feet 230 to move the top surface of the conveyor belt 105 in either direction. For example, the user 200 could brace one foot against the top surface of the conveyor belt 105 while extending their other leg to pushing the top surface of the conveyor belt 105 towards the roller 101 using the ball of their foot, and could repeat the process with opposite feet to rotate the conveyor belt 105 about the rollers 101 and 102. Alternatively, the user 200 could brace one foot against the top surface of the conveyor belt 105 while pushing the conveyor belt 105 towards roller 102 using the heel of their foot while pulling on the handles 120 with their arms, and repeat the process with opposite feet to rotate the conveyor belt 105 about the rollers 101 and 102. Such a configuration allows the user 200 to use the exercise device 100 in multiple ways to exercise the user's leg and buttock muscles.

Figure 8A:
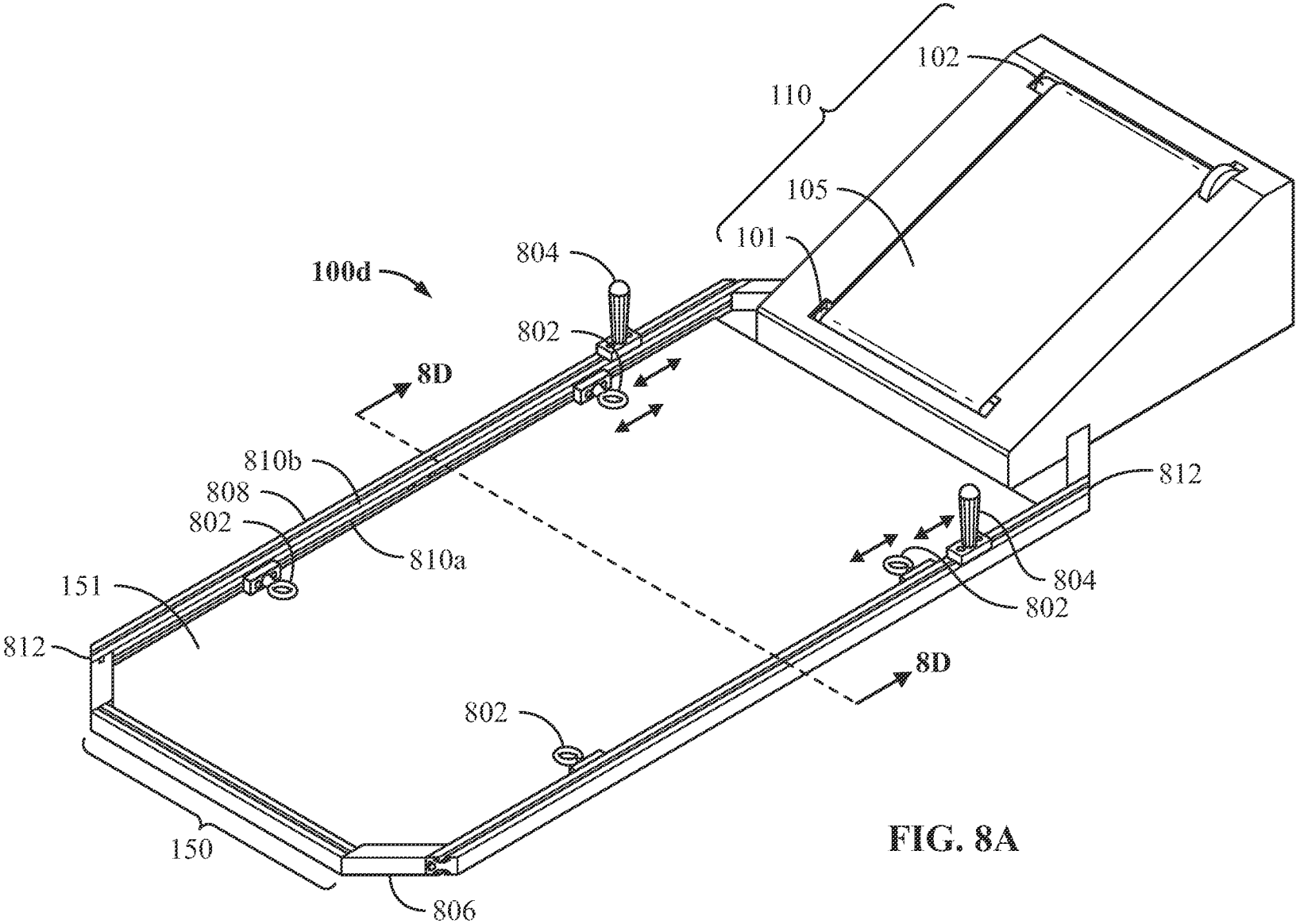
FIG. 8A shows a front perspective view of yet another exercise device.

As discussed elsewhere herein, the weight bar 130 applies a downward force on the user's pelvis area/torso area. However, it is also contemplated that the downward force may be applied with a resistance band 805 as shown and described in relation to FIGS. 8A-D and 9A-C. More particularly, as shown in FIG. 8A, another embodiment of the exercise device 100*d* that is more compact is shown. The exercise device 100*d* may have a base 110 with a continuous belt system having a continuous belt 105 that is taut between at least two rollers 101, 102, as described elsewhere herein. A back support 150 may be attached in front of the continuous belt system of the base 110. By way of example and not limitation, the base 110 having the continuous belt system may be elevated height-wise relative to the back support 150. By way of example and not limitation, the base 110 may have the continuous belt 105 inclining downwards towards the back support 150 such that the incline adds a further level of challenge for the user when using the exercise device 100*d*. The back support 150 may be where a user 200 may rest his back 240 on (see FIG. 8C) when using the exercise device 100*d*, and one or more resistance bands 805 may be attached to the outer frame 806 of the back support 150 to provide a downward resistive force on the user's torso and pelvis area 210-220, especially when the user lifts his pelvis/buttocks 220 off the back support 150 for a more intense exercise session. By way of example and not limitation, the outer frame 806 may surround the lying surface 151 of the back support 150, and the outer frame 806 may have adjustable gripping handles 804 and attachment rings 802 on its left and right sides of the frame.

The gripping handles 804 may be used by the user 200 (see FIG. 8C) during the exercise routines, described elsewhere herein, to help lift his pelvis and buttocks 220 off the ground while lying on the back support 150. The user 200 may also use the gripping handles 804 to obtain better leverage when moving his legs forwards or backwards along the continuous belt 105 of the base 110 during the exercise routines, described elsewhere herein. By way of example and not limitation, the attachment rings 802 may replace the weight bar 130 in the other embodiments, where one or more resistance bands 805 are attached to the attachment rings 802 and stretched laterally along the outer frame 806 to provide the resistance force on the torso and pelvis area 210-220 of the user 200, which the weight bar 130 would have provided in other embodiments. Alternatively, the attachment rings 802 may be used in conjunction with the different examples of weight bars 130 in the other embodiments of the exercise device 100 to add more resistive force on the user's torso and pelvis area 210-220. By way of example and not limitation, the gripping handles 804 and the attachment rings 802 may be adjustable and slidable along the length of the outer frame 806 to accommodate the usage of the exercise device by users of different sizes (e.g., users having different heights).

The outer frame 806 may be designed to hold a lying surface 151 therebetween for the user 200 (see FIG. 8C) to rest his back 240 and buttocks/pelvis 220 (at least initially) on such surface. By way of example and not limitation, the outer frame 806 may have a rectangular, trapezoidal, oval, or any other shape that is big enough to surround the user 200 while he is lying on the lying surface 151 of the back support 150. By way of example and not limitation, the outer frame 806 may have two longitudinal sides 808 and at least one lateral side. By way of example and not limitation, the front edges of the outer frame 806 of the back support 150, which such front edges may extend from the two longitudinal sides 808, may be affixed and attached to the trapezoidal frame of the base 110. Alternatively, the front edges of the outer frame 806 of the back support 150 may be rotatably attached to the trapezoidal frame of the base 110 using the fasteners 136 (see FIG. 6), as described elsewhere herein.

Figure 8B:
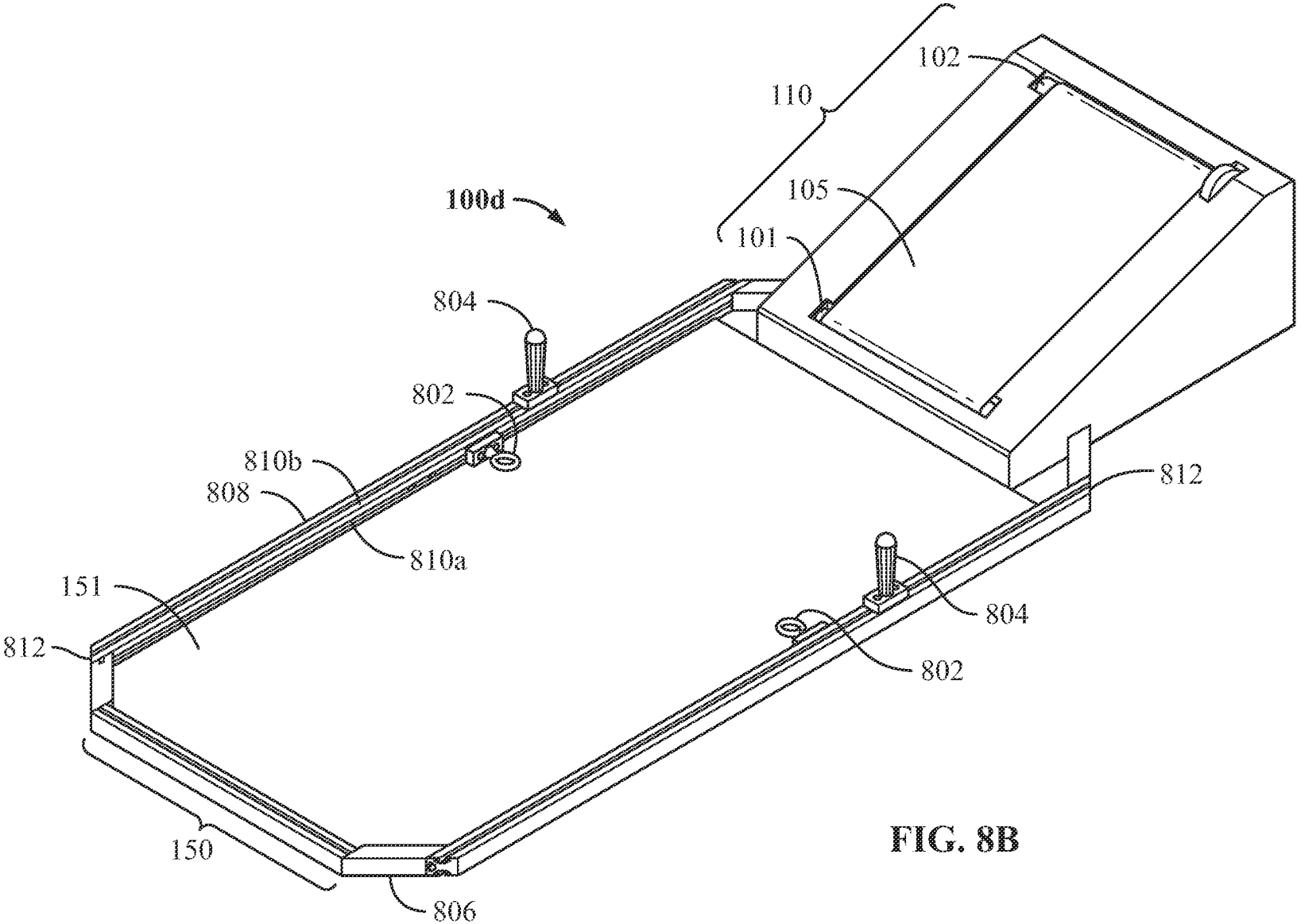
FIG. 8B shows a front perspective view of the exercise device of FIG. 8A with the attachment rings and gripping handles adjusted.

By way of example and not limitation, each of the longitudinal sides 808 of the outer frame 806 may have a plurality of slots 810*a-b* for the slidable insertion and adjustment of the gripping handles 804 and attachment rings 802. The slots 810*a-b* may extend along the length of the left and right longitudinal sides 808 of the outer frame 806, either extending fully or partially along the length. By way of example and not limitation, the slots 810*a-b* may extend partially along the center length portion of the longitudinal sides 808. By way of example and not limitation, the slots 810*b* for the gripping handles 804 may be on upper surfaces (see FIG. 8D) of the longitudinal sides 808 of the outer frame 806, and the slots 810*a* for the attachment rings 802 may be on inner-side surfaces of the longitudinal sides 808 of the frame 806. Alternatively, the upper slots 810*b* may be used for attachment rings 802 and outer or inner-side slots 810*a* for the gripping handles 804. By way of example and not limitation, the gripping handles 804 and/or attachment rings 802 may be inserted within the slots 810*a-b* using slot openings 812 (see FIG. 8A) on the front and rear tips of the longitudinal sides 808 of the outer frame 806. By way of example and not limitation, the slots 810*a-b* may be T-slots or V-slots, or a combination thereof. By way of example and not limitation, the longitudinal sides 808, and the outer frame 806 in general, may be made from an aluminum or steel alloy. As shown in FIG. 8D, and by way of example and not limitation, the outer frame 806 and particularly its longitudinal sides 808 may be made from extrusion profile frames having T-slots or V-slots and being made of aluminum or steel. The extrusion profile frames may be made from 80/20®. By way of example and not limitation, the outer frame 806 and its longitudinal sides 808 may be made from a rigid polymer or composite material instead of aluminum or steel alloy.

By way of example and not limitation, the attachment rings 802 may be slidably adjustable along the length of the outer frame 806 using the inner-side slots 810*a*, as described elsewhere herein. As shown in FIG. 8B, the attachment rings 802 may be adjusted to a desired position on the longitudinal sides 808 of the outer frame 806. By way of example and not limitation, the attachment rings 802 may be fixed into place when slid to the desired position along the length of the outer frame 806. By way of example and not limitation, there may exist at least one attachment ring 802 on each longitudinal side 808 of the outer frame 806. As shown in FIG. 8A, each longitudinal side 808 of the outer frame 806 may have a plurality of attachment rings 802 (e.g., two attachment rings) slidable on the inner-side slots 810*a*. The plurality of attachment rings 802 on each longitudinal side 808 may allow for the binding of multiple resistance bands.

Figure 9A:
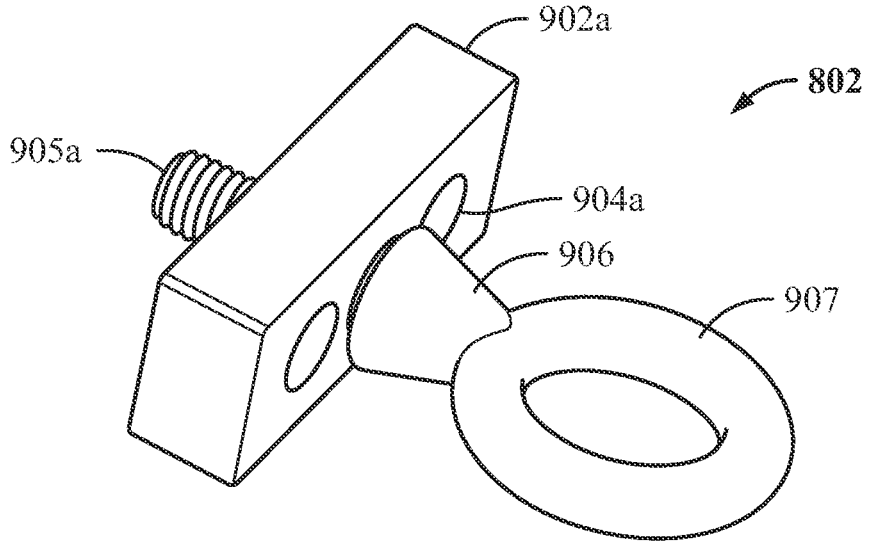
FIG. 9A shows a perspective view of the attachment ring of the exercise device of FIG. 8A.

As shown in FIG. 9A, and by way of example and not limitation, the attachment ring 802 may have a body 906 with a ring portion 907 on one end and a sliding portion 905*a* on the other end, where the sliding portion 905*a* is inserted in a through hole 904*a* of an attachment block 902*a* and extends on the other side of the attachment block 902*a*. By way of example and not limitation, the attachment block 902*a* may have a plurality of through holes 904*a* for inserting the sliding portion 905*a* of the body 906 of the attachment ring 802 to adjust the ring portion 907 along the length of the body of the attachment block 902*a*. By way of example and not limitation, the ring portion 907 may be a hook (e.g., a snap/carabiner hook) instead of a ring, or any other attachment/fastening mechanism that can be considered an attachment component similar to the attachment ring 802. Such attachment components, similar to the attachment ring 802, may also be slidably adjusted along the length of the outer frame 806 using slots 810*a*, as described elsewhere herein and as shown in FIG. 8B. By way of example and not limitation, the sliding portion 905*a* of the body 906 of the attachment ring 802 may be a shaft. By way of example and not limitation, the sliding portion 905*a* may be a threaded shaft and the attachment block holes 904*a* may be correspondingly threaded to fasten the threaded shaft that is the sliding portion 905*a* to the attachment block 904*a*. In another example, the attachment ring 802, or an attachment component in general, may have one unitarily formed body with the ring portion 907 extending on one end of the attachment block 902*a* and the sliding portion 905*a* extending on the opposite end of the attachment block 902*a*. By way of example and not limitation, the attachment ring 802 may be made from a metal alloy, such as aluminum or steel, or be made from a rigid polymer material or composite material.

By way of example and not limitation, the gripping handles 804 may be slidably adjustable along the length of the outer frame 806 using the upper slots 810*b*, as described elsewhere herein. As shown in FIG. 8B, the gripping handles 804 may be adjusted to a desired position on the longitudinal sides 808 of the outer frame 806. By way of example and not limitation, the gripping handles 804 may then be fixed into place when slid to the desired position along the length of the outer frame 806. By way of example and not limitation, there may exist one gripping handle 804 on each longitudinal side 808 of the outer frame 806.

Figure 9B:
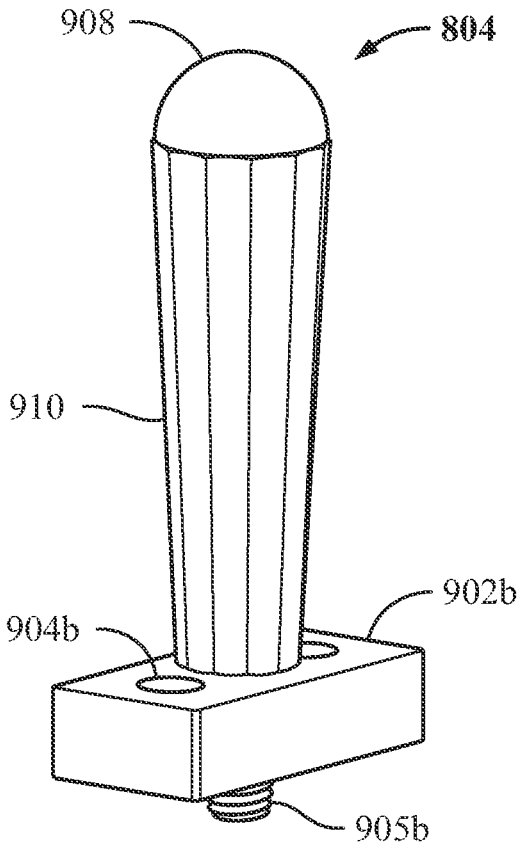
FIG. 9B shows a perspective view of the gripping handle of the exercise device of FIG. 8A.

As shown in FIG. 9B, and by way of example and not limitation, the gripping handle 804 may have a shaft with a gripping portion 910 on one end and a sliding portion 905*b* on the other end, where the sliding portion 905*b* is inserted through a though hole 904*b* of a handle block 902*b* and extends on the other side of the handle block 902*b*. By way of example and not limitation, the handle block 902*b* may have a plurality of through holes 904*b* for inserting the sliding portion 905*b* of the shaft of the gripping handle 804 to adjust the gripping portion 910 along the length of the body of the handle block 902*b*. By way of example and not limitation, the gripping portion 910 may be thicker than the sliding portion 905*b* of the gripping handle 804. By way of example and not limitation, the gripping portion 910 may be cylindrical shaped or prism shaped, where the sides of the lateral faces of the prism act as gripping surfaces. By way of example and not limitation, the outer end of the gripping portion 910 may have a dome shape 908 for ease of gripping the gripping handle 804. By way of example and not limitation, the sliding portion 905*b* may be a threaded shaft and the handle block holes 904*b* may be correspondingly threaded to fasten to the sliding portion 905*b*. By way of example and not limitation, the sliding portion 905*b* may also be a separate component than the gripping portion 910, and the sliding portion 905*b* may be a threaded shaft to screw in a threaded bore on the opposite side of the gripping portion 910 of where the dome shape 908 is located. In another example, the gripping handle 804 may have one unitarily formed body with the gripping portion 910 extending on one end of the handle block 902*b* and the sliding portion 905*b* extending on the opposite end of the handle block 902*b*. By way of example and not limitation, the gripping handle 804 may be made from a metal alloy, such as aluminum or steel, or be made from a rigid polymer material or composite material.

Figure 8C:
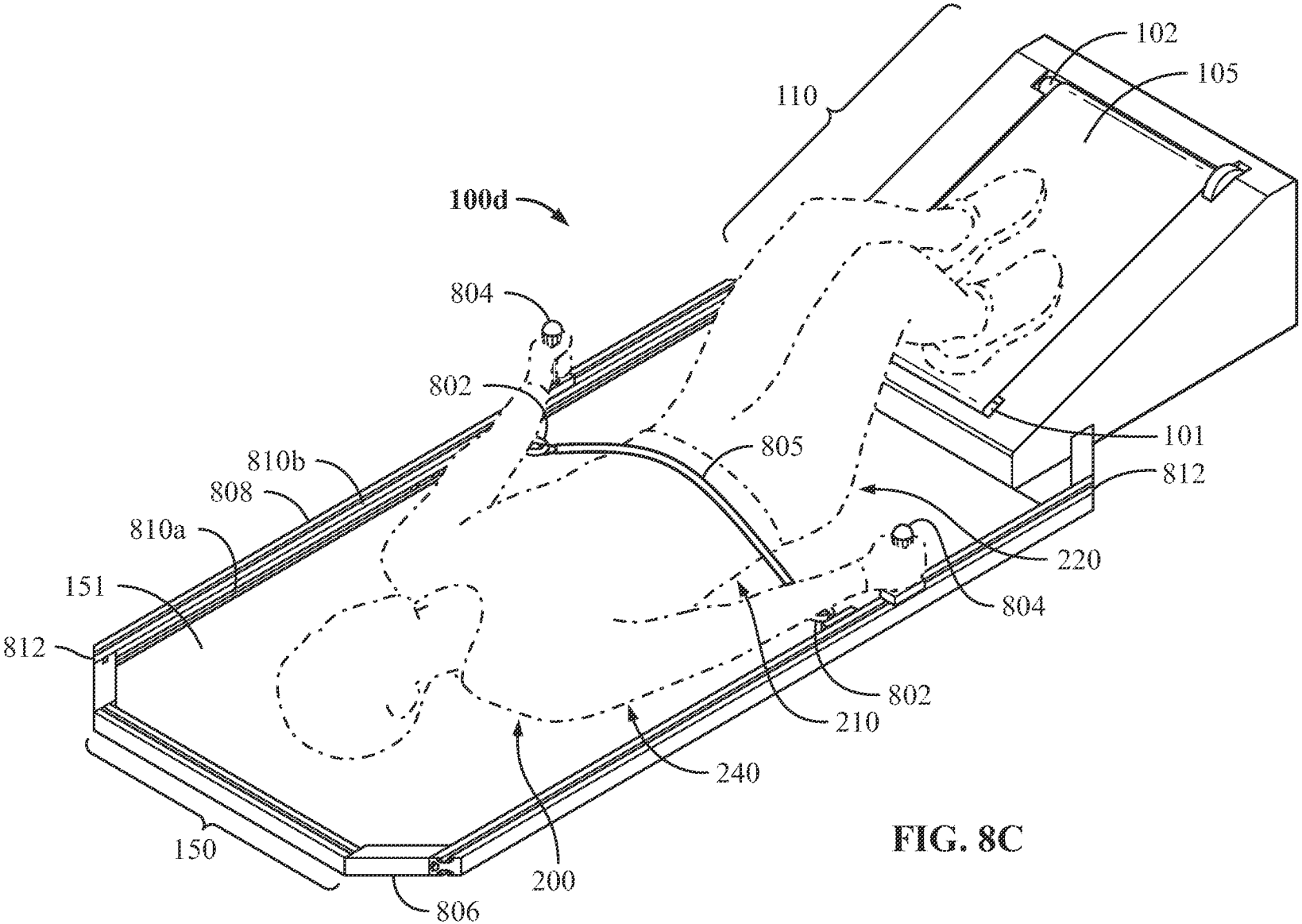
FIG. 8C shows a front perspective view of the exercise device of FIG. 8B with a user using the device with a resistance band attached to the attachment rings.
Figure 8D:
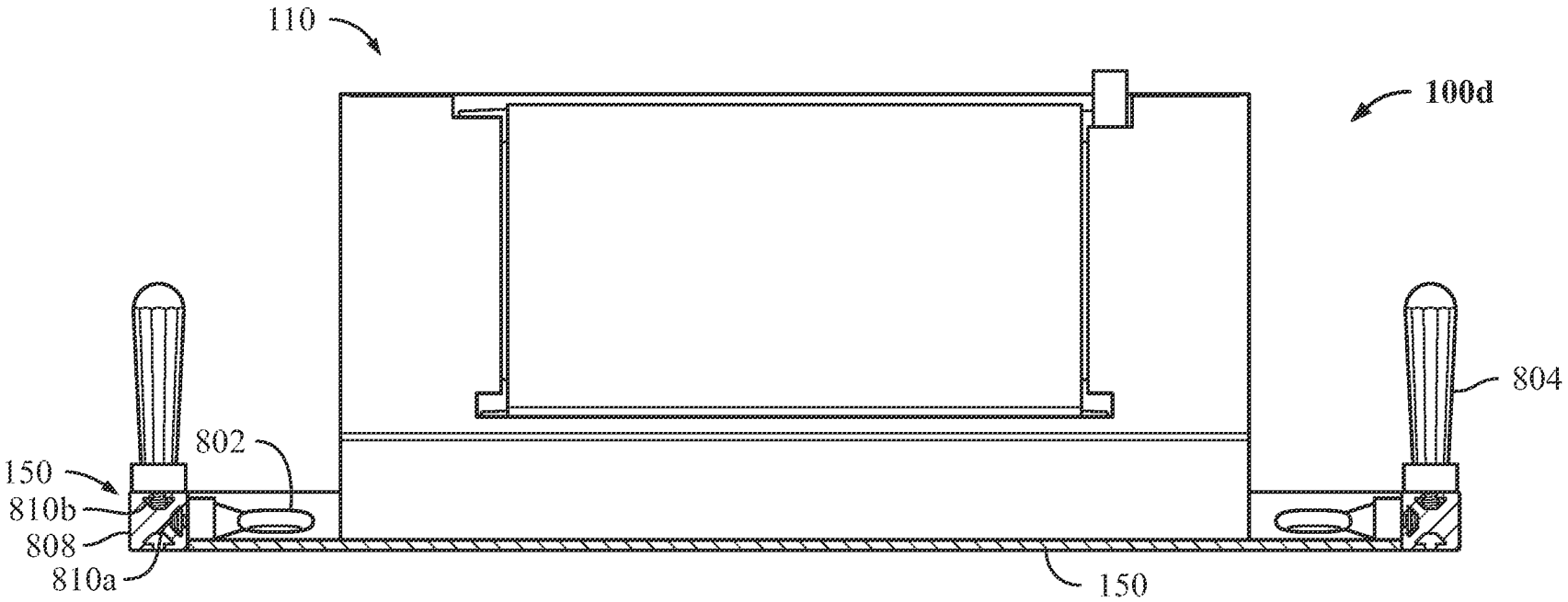
FIG. 8D shows a cross-sectional view of the back support of the exercise device of FIG. 8A.

As shown in FIG. 8C, one or more resistance bands 805 may be stretched laterally between the longitudinal sides

Figure 9C:
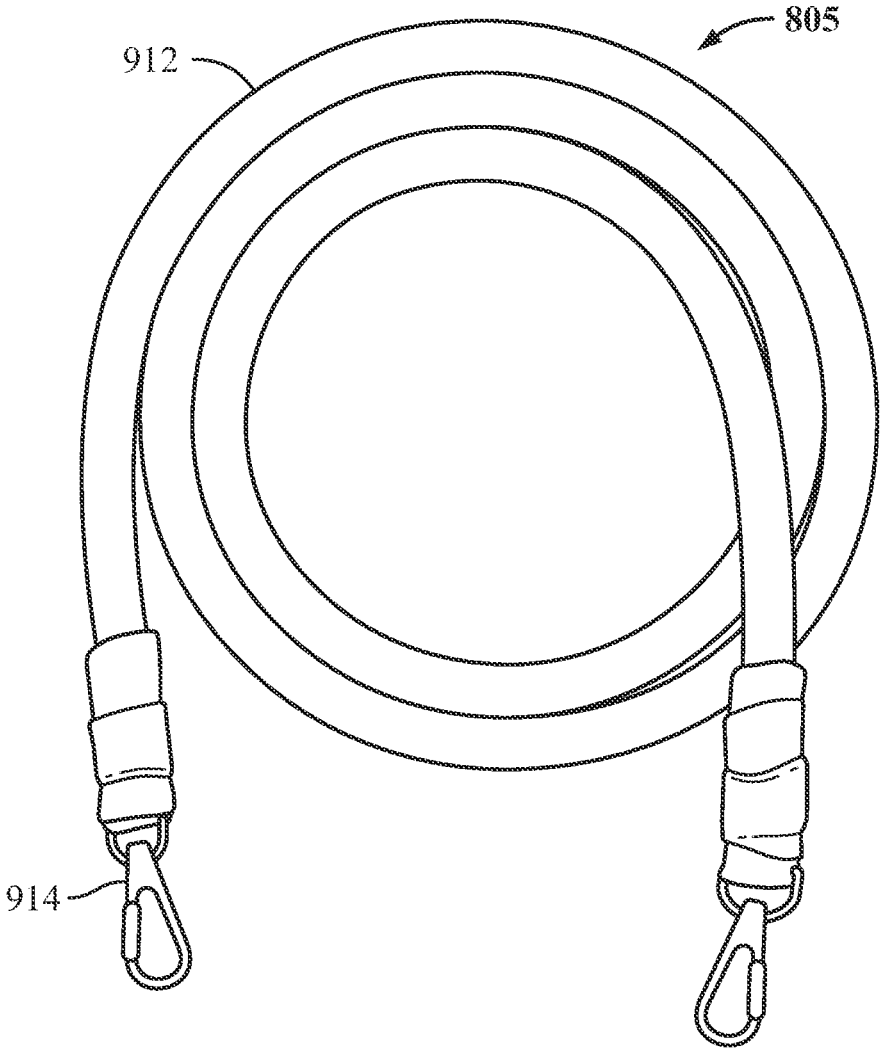
FIG. 9C shows a front view of the resistance band used with the exercise device in FIG. 8C.

808 of the outer frame 806 and attached to the attachment rings 802 such that the resistance band 805 biases again the torso 210 of the user 200. The usage of the resistance band 805 with the attachment rings 802 may be an alternative method to provide the same function as the weight bar 130, shown in other figures and described elsewhere herein, such as providing an added resistance on the torso 210 and pelvis/buttocks region 220 of the user 200 during using the exercise device 100*d* when the person lifts his pelvis and buttocks off from the ground and the back support 150. The usage of the one or more resistance bands 805 with the attachment rings 802, instead of the weight bar 130, may make the assembly and operation of the exercise device 100*d* easier since less mechanical parts need to be combined and used during the workout. Alternatively, the one or more resistance bands 805 may be used in conjunction with the weight bar 130 of the other embodiments of the exercise device. By way of example and not limitation, the one or more resistance bands 805 may each come in different resistance forces ranging from 10 to 100 pounds. As shown in FIG. 9C, each resistance band 805 may have a elastic body 912 with binding mechanisms 914 at the ends of the elastic body 912. By way of example and not limitation, the elastic body 912 may be rope-shaped having an elastically cylindrical body or an elastically rectangular body. By way of example and not limitation, the binding mechanisms 914 may be snap/carabiner hooks, where each binding mechanism 914 may be on one end of the rope-shaped body of the elastic body 912.

It will be appreciated from the foregoing that the exercise device systems and methods disclosed herein can be adapted to a wide variety of uses systems, and that systems employing this system and method can be operated to exercise gluteal muscles as will be suitable to different applications and circumstances. It will therefore be readily understood that the specific embodiments and aspects of this disclosure described herein are exemplary only and not limiting, and that a number of variations and modifications will suggest themselves to those skilled in the pertinent arts without departing from the spirit and scope of the disclosure.

What is claimed is:

1. An exercise device for strengthening gluteus muscles and hamstrings, the exercise device comprising:

a base having a belt system with a continuous belt that is taut between at least two rollers;

a back support attached to a front of the base, the back support having a lying surface between an outer frame of the back support, the outer frame having a first longitudinal side and a second longitudinal side;

a first attachment component coupled to the first longitudinal side of the outer frame; and a second attachment component coupled to the second longitudinal side of the outer frame;

a resistance band attached to the first and second attachment components to apply a downward force on a torso of a user when the user is lying on the lying surface of the back support.

2. The exercise device of claim 1, further comprising a first gripping handle slidably coupled to a first lengthwise slot of the first longitudinal side, and a second gripping handle slidably coupled to a second lengthwise slot of the second longitudinal side.

3. The exercise device of claim 2, wherein the first lengthwise slot is located on a first inner surface of the first longitudinal side and the second lengthwise slot is located on a second inner surface of the second longitudinal side.

4. The exercise device of claim 3, wherein a third lengthwise slot is located on a first upper surface of the first longitudinal side and a fourth lengthwise slot is located on a second upper surface of the second longitudinal side.

5. The exercise device of claim 2, wherein the first gripping handle comprises a shaft body with a gripping portion on one end of the shaft body and a sliding shaft on another end of the shaft body, the sliding shaft inserted through an handle block of the first gripping handle.

6. The exercise device of claim 1, wherein the first longitudinal side has a first lengthwise slot and the second longitudinal side has a second lengthwise slot, the first attachment component being slidably coupled to the first lengthwise slot of the first longitudinal side of the outer frame, and the second attachment component slidably coupled to the second lengthwise slot of the second longitudinal side of the outer frame.

7. The exercise device of claim 6, wherein the first and second lengthwise slots are either V-slots or T-slots.

8. The exercise device of claim 1, wherein the first attachment component comprises a first body having a first attachment ring on one end of the first body and a first sliding shaft on another end of the first body, the first sliding shaft inserted through an attachment block of the first attachment component.

9. The exercise device of claim 1, wherein the first and second attachment components each comprise an attachment ring.

10. The exercise device of claim 1, wherein the first and second attachment components each comprise a snap hook.

11. An exercise device for strengthening gluteus muscles and hamstrings, the exercise device comprising:

a base having a belt system with a continuous belt that is taut between at least two rollers, the belt system being at an incline;

a back support attached to a front of the base, the back support having a lying surface between an outer frame of the back support, the outer frame having a first longitudinal side and a second longitudinal side, the first longitudinal side having a first lengthwise slot and the second longitudinal side having a second lengthwise slot;

a first attachment component slidably coupled to the first lengthwise slot of the first longitudinal side of the outer frame; and a second attachment component slidably coupled to the second lengthwise slot of the second longitudinal side of the outer frame;

wherein the first and second attachment components are configured to have a resistance band attached thereto for the resistance band to apply a downward force on a torso of a user when the user is lying on the lying surface of the back support;

wherein the base is elevated height-wise relative to the back support and the belt system inclines downwards towards the back support.

12. The exercise device of claim 11, further comprising a first gripping handle slidably coupled to a third lengthwise slot of the first longitudinal side, and a second gripping handle slidably coupled to a fourth lengthwise slot of the second longitudinal side.

13. The exercise device of claim 12, wherein the first lengthwise slot is located on a first inner surface of the first longitudinal side and the second lengthwise slot is located on a second inner surface of the second longitudinal side.

14. The exercise device of claim 13, wherein the third lengthwise slot is located on a first upper surface of the first longitudinal side and the fourth lengthwise slot is located on a second upper surface of the second longitudinal side.

15. The exercise device of claim 12, wherein the first gripping handle comprises a shaft body with a gripping portion on one end of the shaft body and a sliding shaft on another end of the shaft body, the sliding shaft inserted through an handle block of the first gripping handle.

16. The exercise device of claim 11, wherein the first and second longitudinal sides are made from extrusion profile frames.

17. The exercise device of claim 16, wherein the first and second lengthwise slots are either V-slots or T-slots.

18. The exercise device of claim 11, wherein the first attachment component comprises a first body having a first attachment ring on one end of the first body and a first sliding shaft on another end of the first body, the first sliding shaft inserted through an attachment block of the first attachment component.

19. The exercise device of claim 11, wherein the first and second attachment components each comprise an attachment ring.

20. The exercise device of claim 11, wherein the first and second attachment components each comprise a snap hook.

* * * * *